US007513708B2

(12) United States Patent
Cheng et al.

(10) Patent No.: US 7,513,708 B2
(45) Date of Patent: Apr. 7, 2009

(54) RING BINDER MECHANISM HAVING SLIDE CONNECTOR

(75) Inventors: Hung Yu Cheng, Hong Kong (CN); Wing Yiu Ng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 184 days.

(21) Appl. No.: 11/216,906

(22) Filed: Aug. 31, 2005

(65) Prior Publication Data

US 2007/0048075 A1 Mar. 1, 2007

(51) Int. Cl.
*B42F 13/00* (2006.01)
*B42F 3/04* (2006.01)
*B42F 13/20* (2006.01)

(52) U.S. Cl. ..... 402/75; 402/38; 402/42

(58) Field of Classification Search ..... 402/19, 402/20, 23, 26, 31, 35–39, 41, 42, 70, 73, 402/76, 77

See application file for complete search history.

(56) References Cited

U.S. PATENT DOCUMENTS

| | | | | |
|---|---|---|---|---|
| 324,212 | A | 8/1885 | Baker | |
| 330,833 | A | 11/1885 | Harger | |
| 446,139 | A | 2/1891 | Richardson | |
| 1,456,036 | A | 5/1923 | Nissen | |
| 1,639,361 | A | 8/1927 | Adams | |
| 1,670,130 | A | 5/1928 | Watson | |
| 1,673,670 | A * | 6/1928 | Finley | 402/37 |
| 1,709,955 | A | 4/1929 | Schade | |
| 1,769,120 | A | 7/1930 | Dawson | |
| 1,841,793 | A | 1/1932 | Dawson | |
| 1,895,972 | A | 1/1933 | Childs | |
| 1,972,452 | A | 9/1934 | Lingo | |
| 2,005,573 | A | 6/1935 | Watson | |
| 2,093,041 | A | 9/1937 | Emery | |
| 2,111,845 | A | 3/1938 | Dunham | |
| 2,243,535 | A | 5/1941 | Newman | |
| 2,311,090 | A | 2/1943 | Schade | |
| 2,321,157 | A | 6/1943 | Rees | |
| 2,374,803 | A | 5/1945 | Broadwell | |

(Continued)

FOREIGN PATENT DOCUMENTS

| | | |
|---|---|---|
| DE | 196 02 813 A1 | 8/1996 |
| EP | 0764549 | 3/1997 |
| EP | 0882603 A1 | 9/1998 |
| GB | 954 417 | 4/1964 |
| GB | 1 111 435 | 8/1968 |
| GB | 1 484 908 | 9/1977 |
| JP | 2003170688 | 6/2003 |
| JP | 2003170689 | 6/2003 |

OTHER PUBLICATIONS

European Search Report for Application No. EP 06 11 9950 dated Jan. 14, 2008, 6 pages.

*Primary Examiner*—Dana Ross
*Assistant Examiner*—Kyle Grabowski
(74) *Attorney, Agent, or Firm*—Senniger Powers LLP

(57) ABSTRACT

A ring binder mechanism comprises a housing, at least one ring for mounting loose leaf paper, and at least one mounting post extending outwardly from the housing. A base plate is adapted to be attached to a ring binder cover and has a surface adapted to receive the mounting post of the ring binder mechanism. A key can be received by the base plate into an affixing position with respect to the base plate and mounting post for securing the mounting post to the base plate.

25 Claims, 36 Drawing Sheets

U.S. PATENT DOCUMENTS 2,512,415 A 6/1950 Buenger et al.
2,562,518 A 7/1951 Abrams
2,568,131 A 9/1951 Segal
2,888,934 A 6/1959 Segal
2,986,060 A 5/1961 Lifka
3,159,411 A 12/1964 McKowen
3,175,847 A 3/1965 McKowen
3,252,461 A 5/1966 Schade
3,262,454 A * 7/1966 Shillinger ..... 402/70
3,305,957 A 2/1967 Sobesky
3,645,561 A 2/1972 Kendall
3,809,485 A 5/1974 Beyer
3,950,107 A 4/1976 Seaborn
3,993,374 A 11/1976 Schudy
4,295,747 A 10/1981 Errichiello
4,400,107 A 8/1983 Pitts
4,552,478 A 11/1985 Cohen
4,584,737 A * 4/1986 Ohman ..... 16/87.4 R
4,697,945 A 10/1987 Geiger
4,722,628 A 2/1988 Rager
4,773,787 A * 9/1988 Chang ..... 402/60
4,904,102 A 2/1990 Handler
4,935,998 A 6/1990 Frazier et al.
4,943,177 A 7/1990 Jordan et al.
5,035,526 A 7/1991 Cooper et al.
5,100,253 A 3/1992 Cooper
5,106,223 A 4/1992 Kraus
5,120,149 A 6/1992 Smith
5,158,387 A 10/1992 Davies
5,160,209 A 11/1992 Schuessler
5,180,247 A 1/1993 Yu
5,199,809 A 4/1993 Semerjian
5,265,967 A 11/1993 Han
5,269,616 A 12/1993 O'Neill
5,286,128 A 2/1994 Gillum
5,348,412 A 9/1994 Fuller
5,354,142 A 10/1994 Yu
5,368,407 A 11/1994 Law
5,378,073 A 1/1995 Law
5,393,155 A 2/1995 Ng
D356,945 S 4/1995 Kinner
5,476,335 A 12/1995 Whaley
5,511,301 A 4/1996 McGuire
5,577,852 A 11/1996 To
5,634,666 A 6/1997 Lee
5,688,091 A 11/1997 McKinlay
5,704,100 A * 1/1998 Swan ..... 24/656
5,718,530 A 2/1998 Tibbets
5,755,513 A 5/1998 To
5,772,348 A 6/1998 To
5,803,692 A 9/1998 Postadan
5,842,807 A 12/1998 To
5,864,934 A 2/1999 Young
5,879,097 A 3/1999 Cheng
5,882,135 A * 3/1999 Ko ..... 402/36
5,924,811 A * 7/1999 To et al. ..... 402/26
5,971,649 A 10/1999 To
D419,598 S 1/2000 Whaley
6,019,538 A 2/2000 Whaley
6,033,144 A 3/2000 Ng et al.
D422,307 S 4/2000 Whaley
6,132,153 A 10/2000 LeVey
6,168,339 B1 1/2001 To
D438,244 S 2/2001 Whaley
6,357,951 B1 3/2002 Tibbetts
6,357,952 B1 3/2002 McKeown
6,394,686 B1 5/2002 Whaley
6,419,416 B1 * 7/2002 Tomoda ..... 402/18
D461,498 S 8/2002 To et al.
6,438,808 B1 8/2002 Kung
6,470,535 B1 10/2002 Mayne
D466,153 S 11/2002 To et al.
6,511,244 B1 1/2003 Cohen
6,659,676 B2 12/2003 Zheng
6,746,171 B2 6/2004 Welch
6,749,357 B2 6/2004 Cheng
RE38,731 E 5/2005 To
7,032,274 B2 4/2006 Kumagai
7,097,378 B2 8/2006 Peleman
7,175,152 B2 2/2007 Dittmer
7,192,234 B2 3/2007 Anderson et al.
2002/0076262 A1 6/2002 To
2002/0131810 A1 9/2002 Whaley
2005/0127260 A1 6/2005 Dittmer

* cited by examiner

RING BINDER MECHANISM HAVING SLIDE CONNECTOR

BACKGROUND OF THE INVENTION

This invention relates to ring binders for retaining loose-leaf pages, and in particular to a fastening system for attaching a ring binder mechanism to a cover to form the ring binder.

Conventional ring binders are made by securing a ring binder mechanism to a cover using rivets. Commonly, ring binder mechanisms include a housing and a plurality of ring members attached to the housing for retaining loose-leaf pages, such as hole-punched pages. Typically, the ring binder mechanism is secured to the cover by inserting the rivets through the cover and openings in the ring binder mechanism. The tail of each of the rivets is then deformed (e.g., by punching) to engage the ring binder mechanism. Once assembled, the ring binder is packaged and shipped to a distributor, a retailer, or directly to an end user (i.e., consumer).

One of the drawbacks of traditional ring binders relates to their shipping and storage after they are assembled. When assembled, large gaps exist between the ring binder mechanism and the cover for each ring binder leaving large amounts of room unused during shipping and storing of multiple ring binders. Thus, the number of ring binders in each package is greatly limited. As a result, packaging and shipping conventional ring binders is inefficient which results in significant shipping and handling costs. Moreover, even a limited number of ring binders occupy a substantial amount of storage space or retail display space.

In response to this drawback, manufacturers of ring binders typically pack the mechanisms in alternating directions. But even this packing technique leaves large amounts of unused space. Further efforts to overcome some of the short comings of conventional ring binders have been disclosed in coassigned U.S. Pat. Nos. 5,924,811 to To et al., 5,879,097 to Cheng, and 5,160,209 to Schuessler, all of which are hereby incorporated by reference in their entireties.

SUMMARY OF THE INVENTION

In one aspect, a ring binder mechanism of the present invention generally comprises a housing, at least one ring for mounting loose leaf paper, and at least one connector member extending outwardly from the housing. A base plate is adapted to be attached to a substrate and has a surface adapted to receive the connector member of the ring binder mechanism. A key is adapted for sliding reception by the base plate into an affixing position with respect to the base plate and connector portion of the housing for securing the connector member of the ring binding mechanism to the base plate.

In another aspect, a ring binder of the present invention generally comprises a ring binder mechanism including a housing having at least one ring for mounting loose leaf paper. A cover has a front panel, a back panel and a spine. The front and back panels are hingedly attached to the spine so that the panels are movable to selectively cover or expose loose leaf pages retained by the ring binder mechanism. A fastening component secures the ring binding mechanism to the cover and includes a lip for covering at least a portion of an edge of one of the spine, front panel, and back panel.

In yet another aspect, the present invention is direct to a method of attaching a ring binder mechanism to a cover. The ring binder mechanism generally comprises a housing including at least one ring for mounting loose leaf paper thereon and at least one connector member extending outwardly from the housing. The method generally comprises attaching at least one base plate to the cover. The base plate is adapted to receive a portion of the connector member. The method further comprises engaging the connector member of the ring binder mechanism with the base plate and sliding a key into the base plate thereby to capture the connector member of the base plate.

In still a further aspect, a ring binder of the present invention generally comprises a cover having at least one panel and a ring binder mechanism mounted on the panel. The ring binder mechanism includes a housing having at least one ring for mounting loose leaf paper. An edge protector covers at least a portion of an edge of the panel.

Other objects and features of the present invention will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
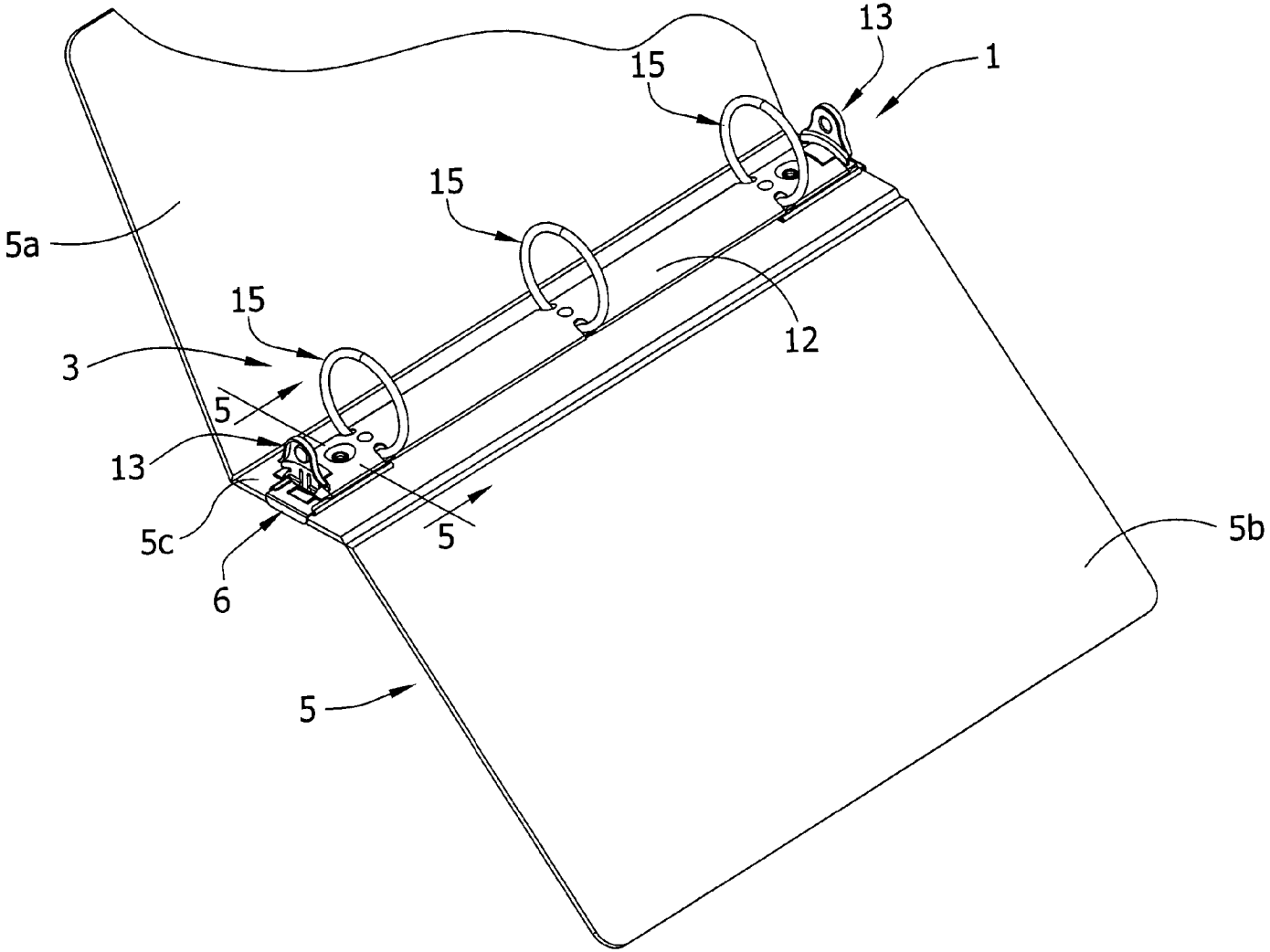
FIG. 1 is a fragmentary perspective of a ring binder including a cover and a ring binder mechanism attached to the cover, the ring binder mechanism being attached to the cover using a fastening system of the present invention.
Figure 2:
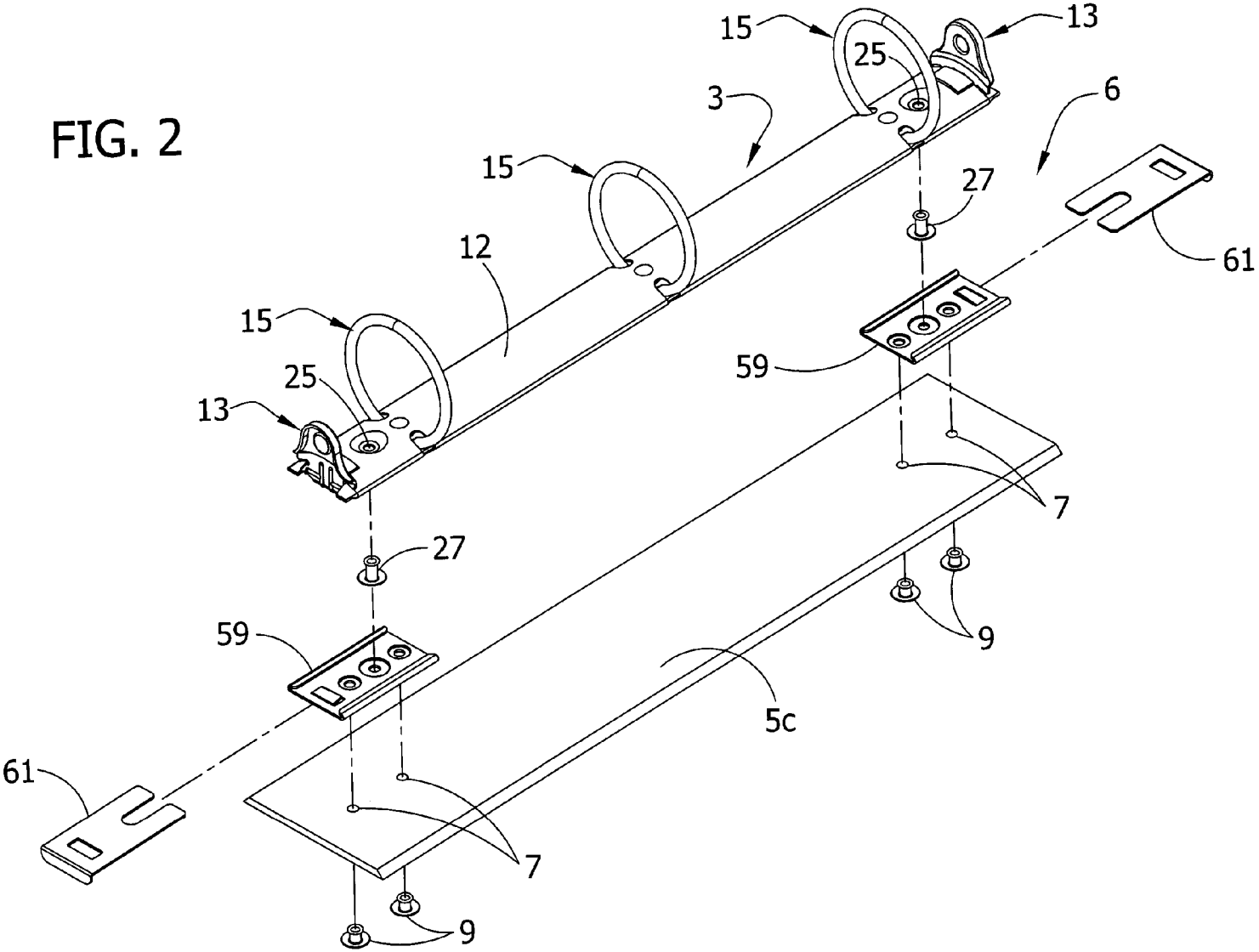
FIG. 2 is a perspective of the ring binder mechanism exploded from a spine of the cover.

Referring now to the drawings, and particularly to FIGS. 1 and 2, a ring binder according to the present invention is designated generally by reference numeral 1. The ring binder 1 comprises a ring binder mechanism 3 affixed on a cover 5 (broadly, "a substrate") using a fastening system 6 of the present invention. The cover, ring binder mechanism, and fastening system are indicated generally by their respective reference numbers. The cover 5 includes a front panel 5*a* (part of which is broken away), a back panel 5*b*, and a spine 5*c*. The front and back panels 5*a*, 5*b* are hingedly attached to the spine 5*c* so that they are movable to selectively cover or expose loose leaf pages (not shown) retained by the ring binder mechanism 3. As shown in FIG. 2, the spine 5*c* of the cover 5 includes four, aligned apertures 7 for receiving rivets 9. Two of the apertures 7 are located generally adjacent one end of the spine 5*c* and the other two apertures are located generally adjacent the other end of the spine. The number of apertures 7 may be other than four and be within the scope of the present invention. While the ring binder mechanism 3 is shown affixed on the spine 5*c* of the cover 5, it is understood that the ring binder mechanism 3 can be affixed on the front panel 5*a* or the back panel 5*b* of the cover 5. Moreover, the ring binder mechanism 3 can be mounted on substrates other than the cover 5, such as files, without departing from the scope of the present invention.

As shown in FIGS. 1-5, the ring binder mechanism 3 includes an elongate housing 12 that supports two substantially similar actuating levers (each designated generally by reference numeral 13) and three rings (each designated generally by reference numeral 15). The housing 12 is symmetrical with a roughly arch-shaped cross section (see FIG. 5) and includes a longitudinal axis, two transversely opposite longitudinally extending edges, and two longitudinal ends (see FIG. 2). Each lever 13 pivotally mounts on the housing 12, generally at an opposite longitudinal end, for controlling movement of the rings 15 between a closed position (see FIG. 6) and an open position (see FIG. 8).

Figure 6:
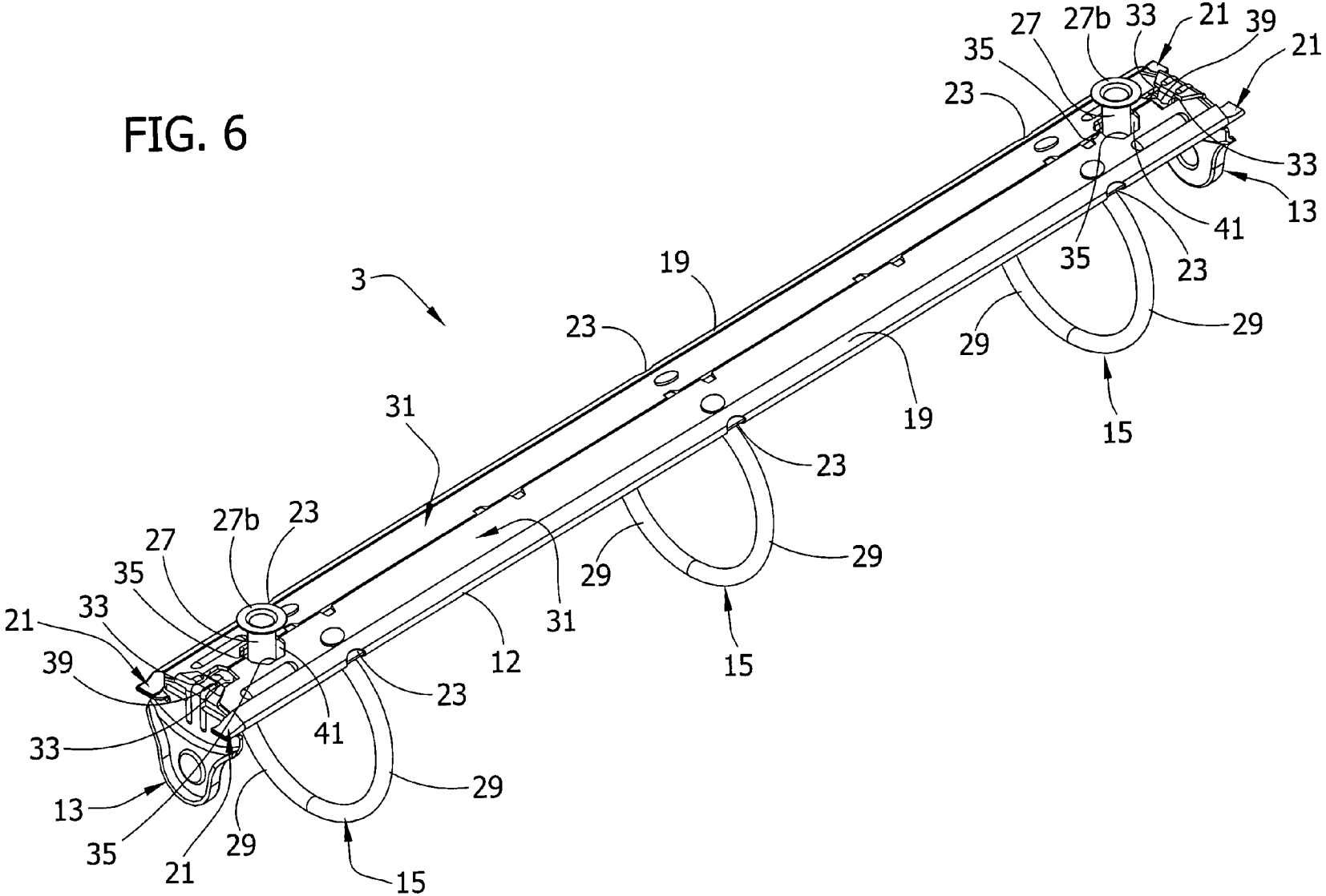
FIG. 6 is an bottom side perspective of the ring binder mechanism.
Figure 7:
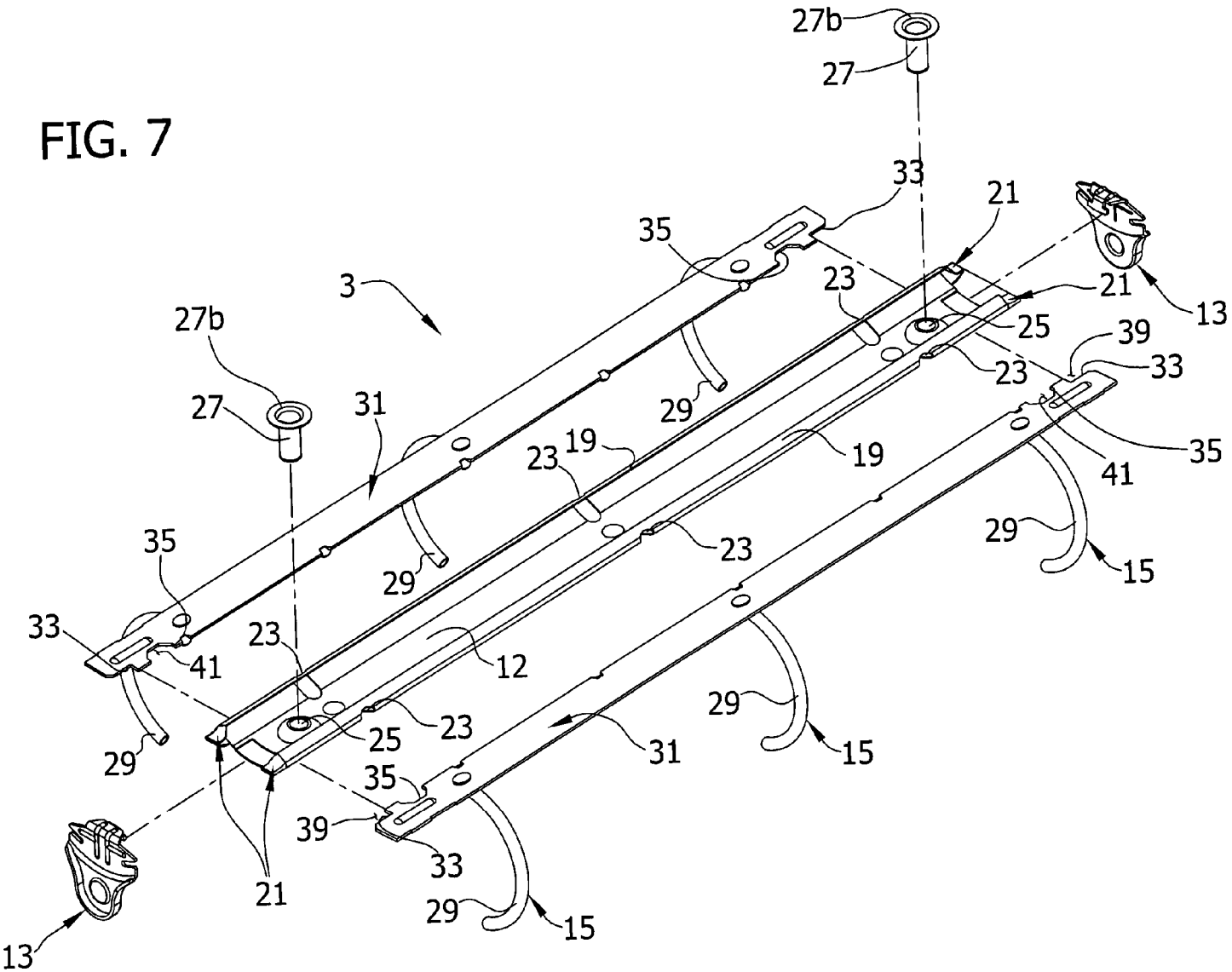
FIG. 7 is an exploded perspective of the ring binder mechanism.

As best shown in FIGS. 6 and 7, a bent under rim 19 formed along each longitudinal edge of the housing 12 extends the full length of the housing from one longitudinal end to the other. Each end of the two bent under rims 19 is pinched together with a portion of an upper surface of the housing 12 to form four pockets (each pocket being designated by reference numeral 21). Accordingly, there are two pockets 21 located at each end of the housing 12. Six total slots 23 are positioned along the two bent under rims 19. The slots 23 are arranged in three transversely opposed pairs with each pair receiving one of the rings 15 therethrough, allowing each ring to move laterally of the housing 12 for opening and closing. As shown in FIG. 2, two additional circular openings 25 are provided in the upper surface of the housing 12, near the longitudinal ends, each receiving and attaching mounting posts 27 (broadly, "connector members") to the housing 12. It is envisioned that the housing of the present invention is made of metal, but it may be made of any other suitable material that is sufficiently rigid to provide a stable mount for components of the mechanism. In addition, differently shaped housings, including asymmetrical ones, do not depart from the scope of this invention.

Figure 8:
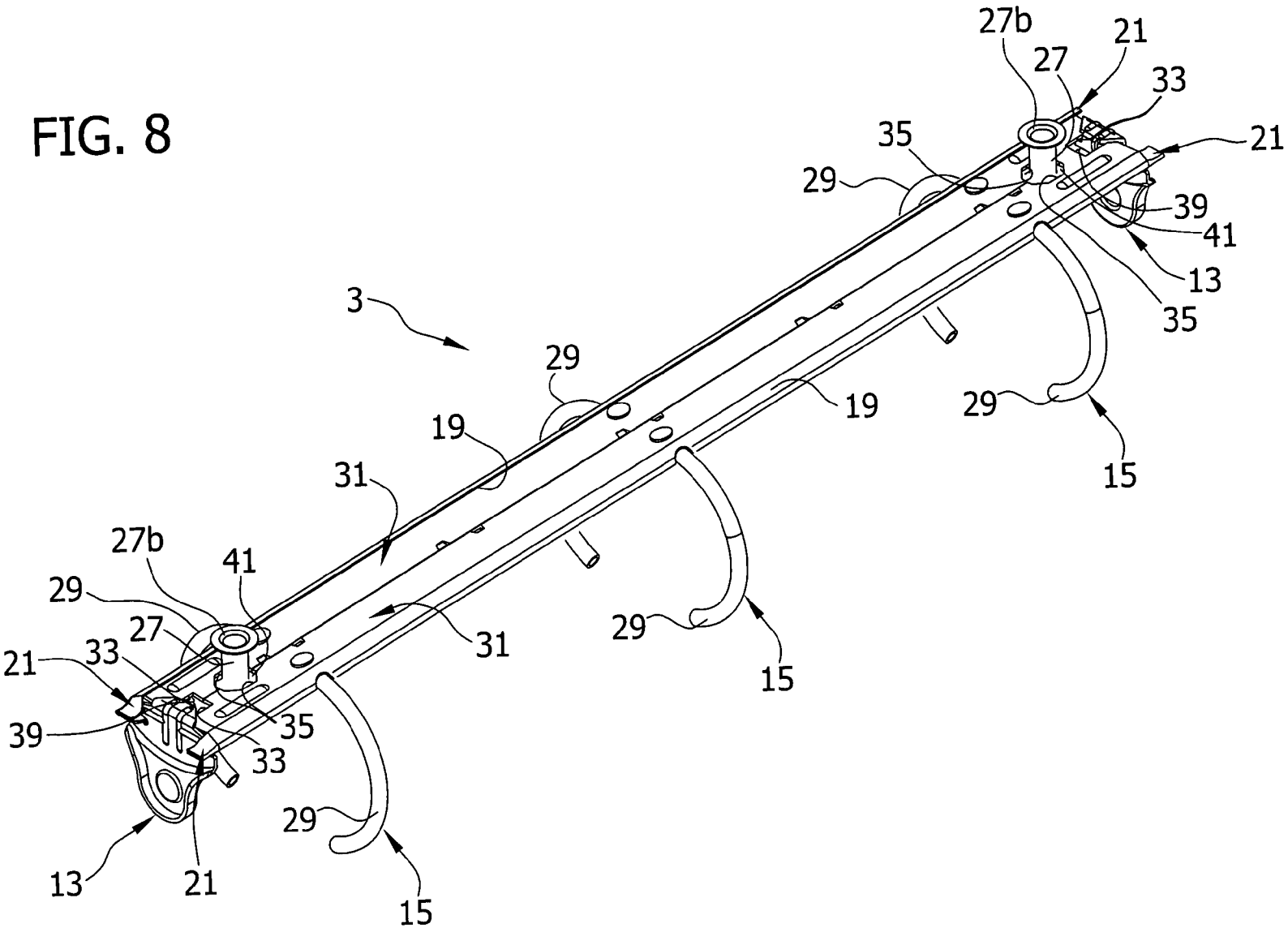
FIG. 8 is the perspective of FIG. 6 but with the ring members in an open position.

Each of the rings 15 includes two ring members 29, which are supported by the housing 12 for movement relative to one another between a closed position (see FIG. 6) and an open position (see FIG. 8). In the closed position, the ring members 29 form a substantially continuous, closed, ring or loop for retaining loose-leaf pages and for allowing the pages to move along the rings 15 from one ring member 29 to the other. In the open position, each ring member 29 forms a discontinuous, open loop suitable for adding or removing pages. It is envisioned that the ring members are formed of a conventional, cylindrical rod of suitable material, such as steel. But it is understood that ring members having a different cross section or ring members made of different material do not depart from the scope of the present invention. Although in the illustrated mechanism both ring members can move, mechanisms having one movable ring member and one fixed do not depart from the scope of the invention. In addition, mechanisms with greater or fewer than three rings or with rings that form other shapes, such as slanted "D" shapes, when ring members are closed, do not depart from the scope of this invention.

As shown in FIGS. 6-8, the two ring members 29 of each ring 15 are mounted opposite each other on one of a pair of hinge plates (each hinge plate being designated generally by reference numeral 31). The hinge plates 31 are each thin and elongate, having an inner and an outer longitudinal edge margin and two longitudinal ends. Each hinge plate 31 additionally includes two squared notches 33 and two rounded cutouts 35, each of which are located along the inner longitudinal edge margin of the hinge plate. The two notches 33 are each located at a respective longitudinal end of the hinge plate 31, and the two cutouts 35 are each located inward from a one of the respective notches 33 but still generally adjacent the hinge plate's ends.

Referring again to FIGS. 6 and 8, the hinge plates 31 attach to one another in parallel arrangement along their inner longitudinal edge margins, forming a central hinge having a pivot axis. The housing 12 loosely receives the outer longitudinal edge margins of the interconnected hinge plates 31 above its two bent under rims 19. Thus, the hinge plates 31 are retained on the housing 12 while the outer longitudinal edge margins are free to move within the rims 19. Corresponding notches 33 of the adjoining hinge plates align to form two box-shaped recesses 39 at opposite longitudinal ends of the plates 31. These recesses 39 are sized and shaped to interact with the actuating levers 13, as will be described in more detail hereinafter. Similarly, corresponding cutouts 35 align to form two openings 41, each sized and shaped for receiving one of the mounting posts 27 through the hinge plates 31. In the illustrated ring binder mechanism the box-shaped recesses 39 and the oval openings 41 are both symmetrically positioned about the pivot axis of the interconnected hinge plates 31. However, mechanisms in which openings and recesses are positioned differently about a pivot axis of interconnected hinge plates do not depart from the scope of the present invention.

The housing 12 is slightly narrower than the joined hinge plates 31 when the hinge plates are in a coplanar position (i.e., an angle between exterior surfaces of the hinge plates is 180°). So as the hinge plates 31 pivot through this position, they deform the resilient housing 12 and cause a spring force in the housing that urges the hinge plates 31 to pivot away from the coplanar position, either closing the ring members 29 (i.e., moving the pivot axis down and away from the housing's upper surface (FIG. 6)) or opening them (i.e., moving the pivot axis up and toward the housing's upper surface (FIG. 8)). Moreover, when the ring members 29 are closed, this spring force resists hinge plate movement and clamps the ring members together. When the ring members 29 are open, the spring force holds them apart. Thus, the illustrated embodiment uses a conventional arrangement to move the hinge plates 31 and ring members 29. It will be understood that other ways of moving the rings members 29 and locking them in a closed position or open position may be used within the scope of the present invention.

Figure 9A:
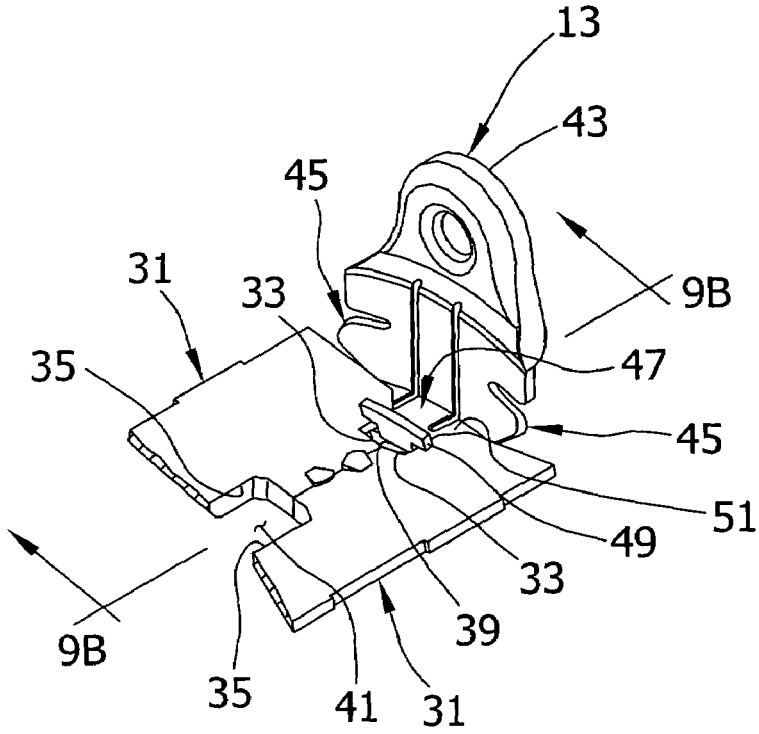
FIG. 9A is an enlarged fragmentary perspective of the ring binder mechanism with a housing removed and showing a lever connected to hinge plates.
Figure 9B:
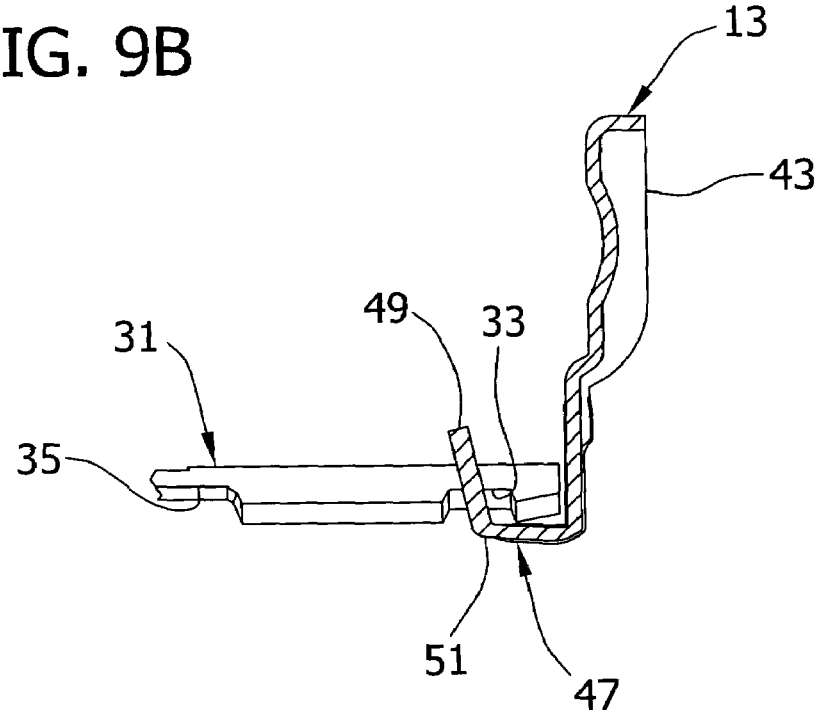
FIG. 9B is a section taken on line 9B-9B of FIG. 9A.

The two actuating levers 13 are generally shown in FIGS. 1-4, 9A and 9B. Each lever 13 includes a relatively flat head 43 that extends upward, generally above the housing 12, for grasping to pivot the lever. Each additionally includes two lateral arms, each designated by reference numeral 45, and a cam, designated generally by reference numeral 47. As best shown in FIG. 9A, the lateral arms 45 extend laterally outward from opposite sides of each lever 13 below the flat head 43. The two arms 45 of each lever loosely fit within the two pockets 21 located at each longitudinal end of the housing 12, allowing the levers 13 to pivot within the pockets 21 relative to the housing about an axis transverse to the housing (FIGS. 6 and 8). Referring again to FIGS. 9A and 9B, the cam 47 of each lever is integrally attached to the lever 13 below the lateral arms 45. It extends downward from the arms 45 and curves outward from the flat head 43, fitting into one of the respective box-shaped recesses 39 of the hinge plates 31. An enlarged tab 49 of each cam fits loosely over the interconnected hinge plates 31 while a base 51 of each cam rests below the plates. Together, the tab 49 and base 51 capture the hinge plates 31 therebetween for operable engagement to control the pivoting motion of the hinge plates that close and open the ring members 29. In operation to close the ring members 29, the levers 13 are pivoted upward and inward. The tabs 49 engage a top surface of the hinge plates 31 and pull the pivot axis of the plates downward. To open the ring members 29, the levers 13 are pivoted outward and downward. The bases 51 engage a bottom surface of the hinge plates 31 and push the pivot axis of the plates upward. Mechanisms (not shown) having levers with different shapes or levers pivotally attached to a housing differently do not depart from the scope of the present invention. In addition, mechanisms having only one lever for driving the hinge plates do not depart from the scope of the present invention.

Figure 13:
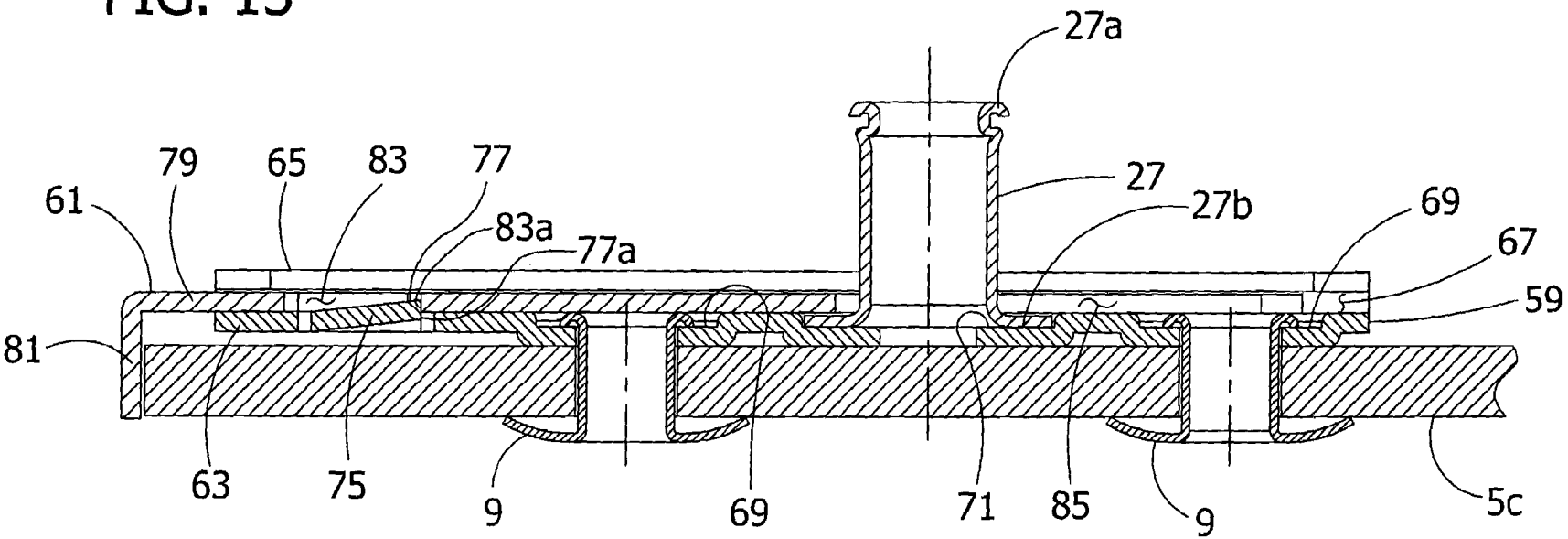
FIG. 13 is a section taken on line 13-13 of FIG. 12.
Figure 14:
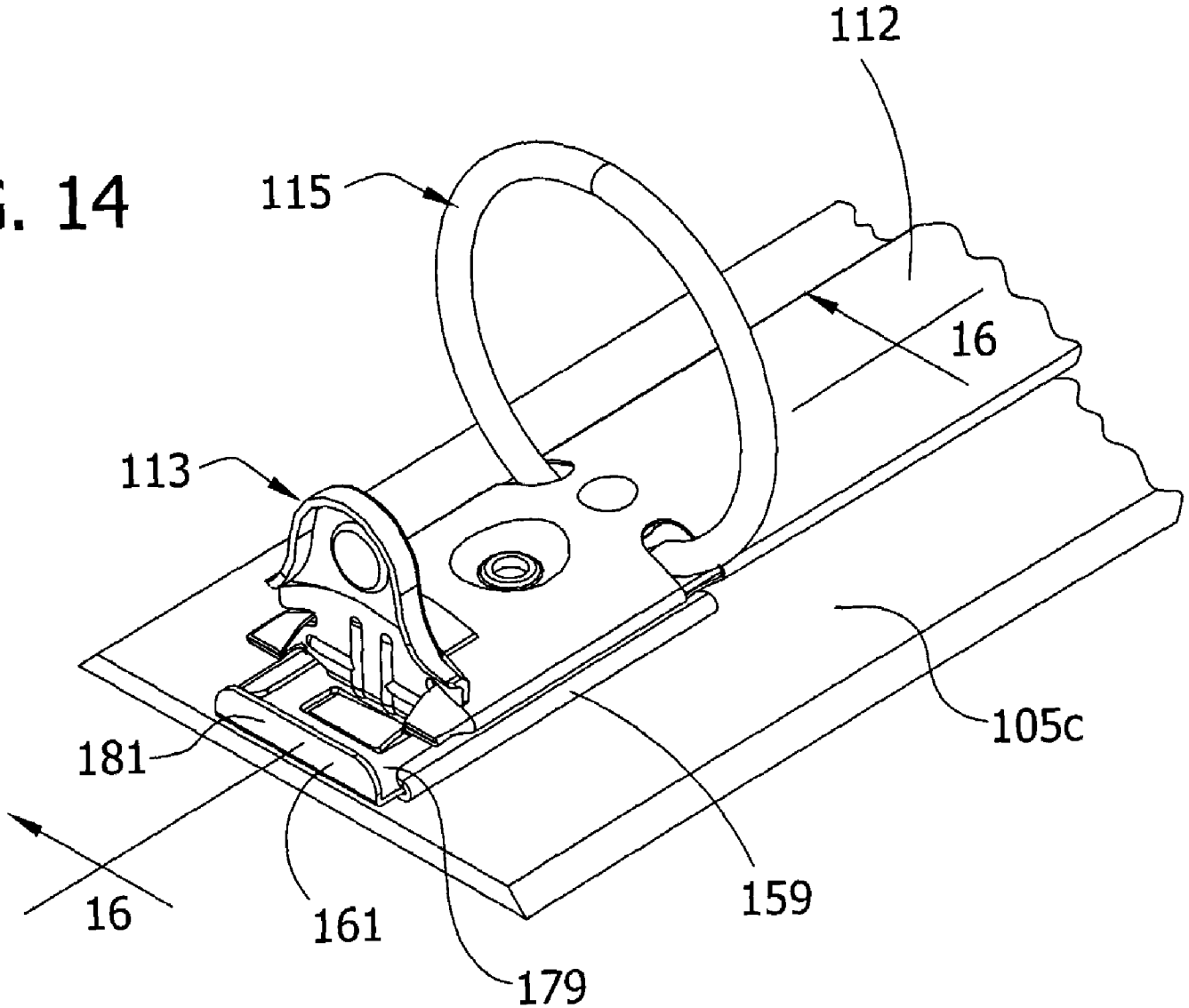
FIG. 14 is a fragmentary perspective of a ring binder mechanism and ring binder spine having a fastening system of another configuration.
Figure 15:
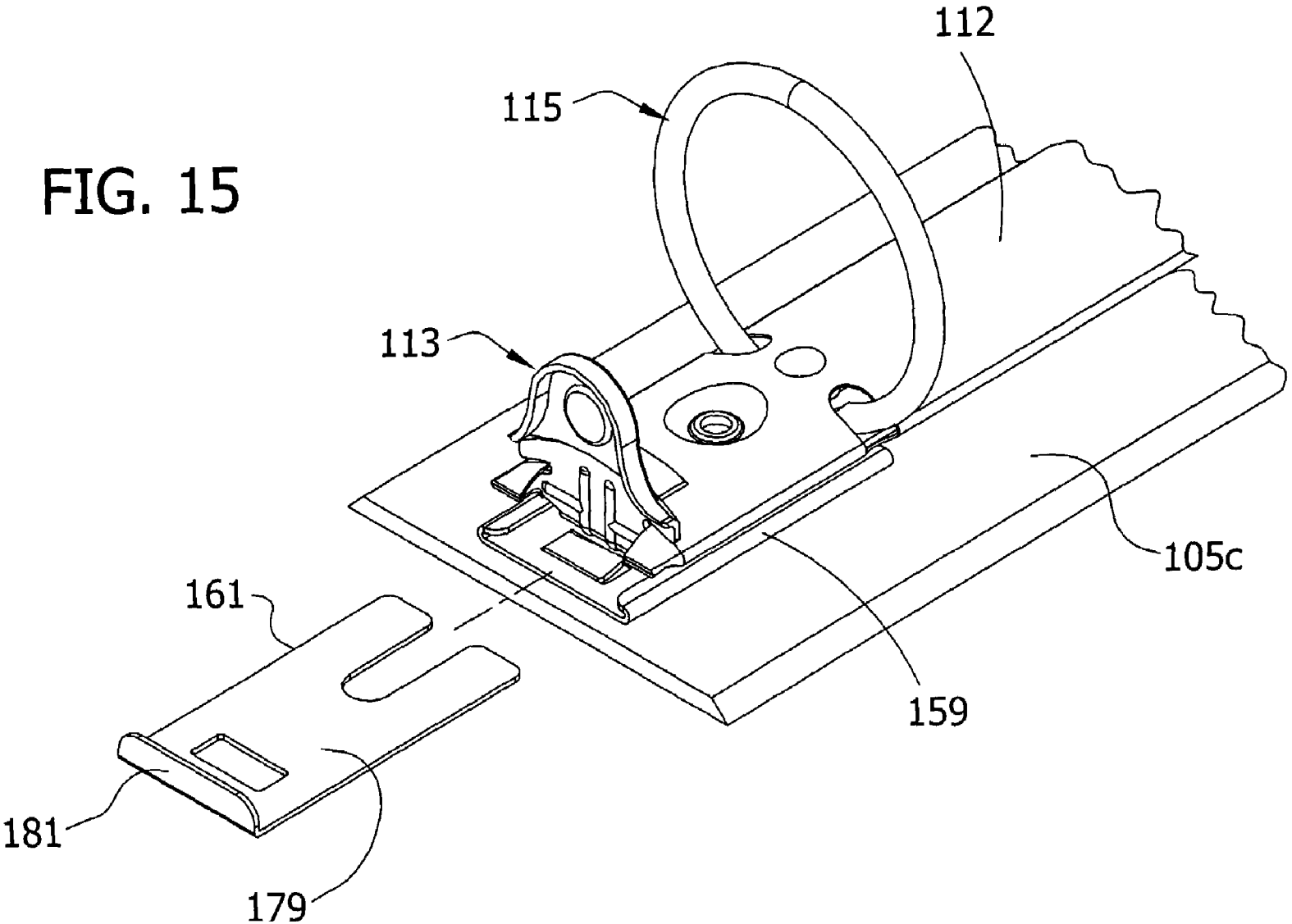
FIG. 15 is a perspective similar to FIG. 14 but showing a key disengaged from a base plate.
Figure 16:
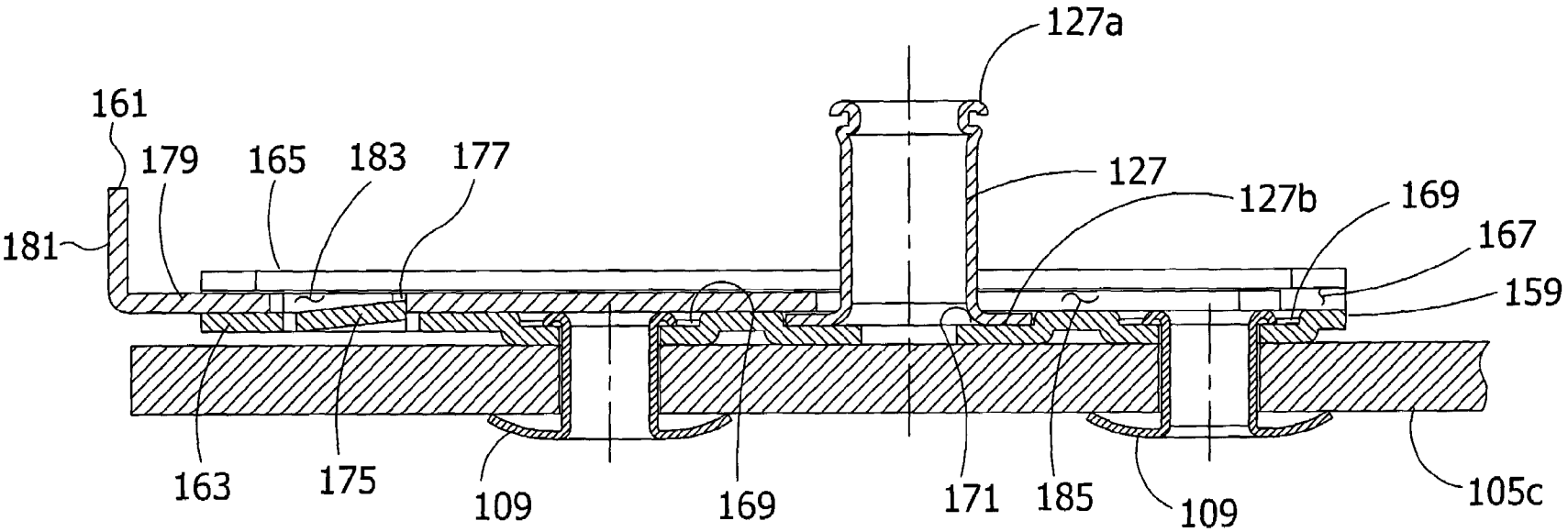
FIG. 16 is a section taken on line 16-16 of FIG. 14.
Figure 17:
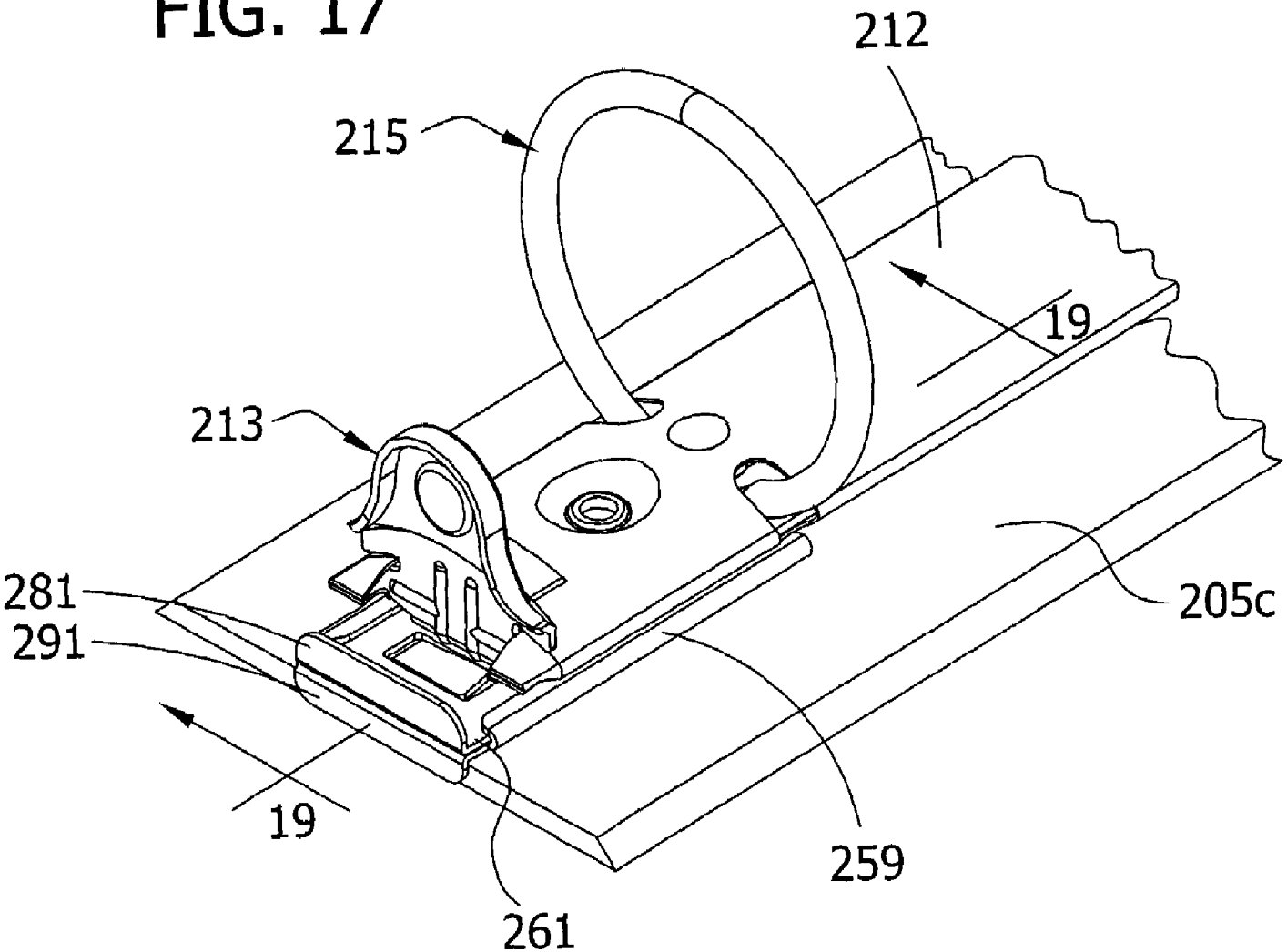
FIG. 17 is a fragmentary perspective of a ring binder mechanism and ring binder spine having a fastening system of yet another configuration.
Figure 18:
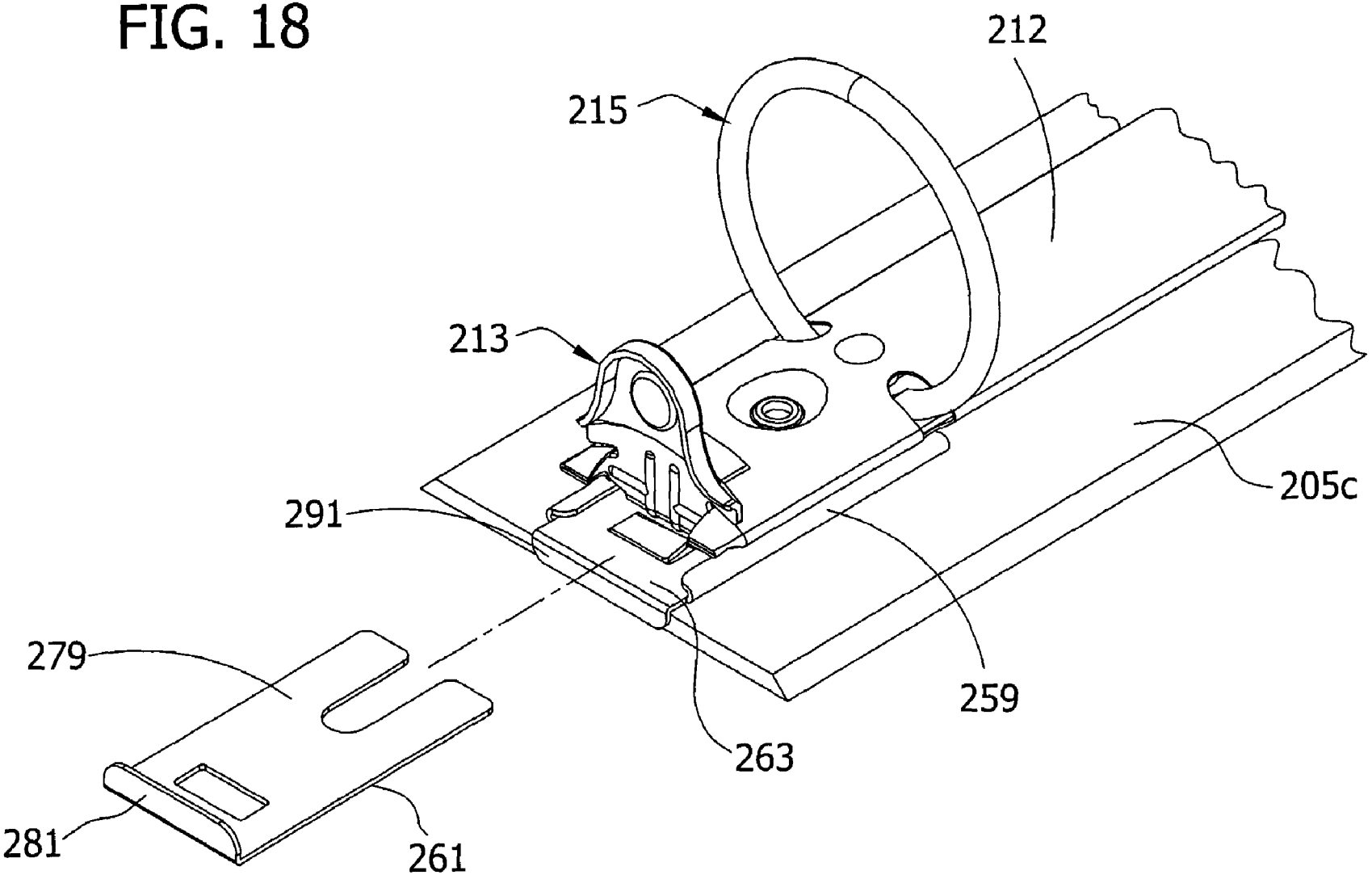
FIG. 18 is a perspective similar to FIG. 17 but showing a key disengaged from a base plate.
Figure 19:
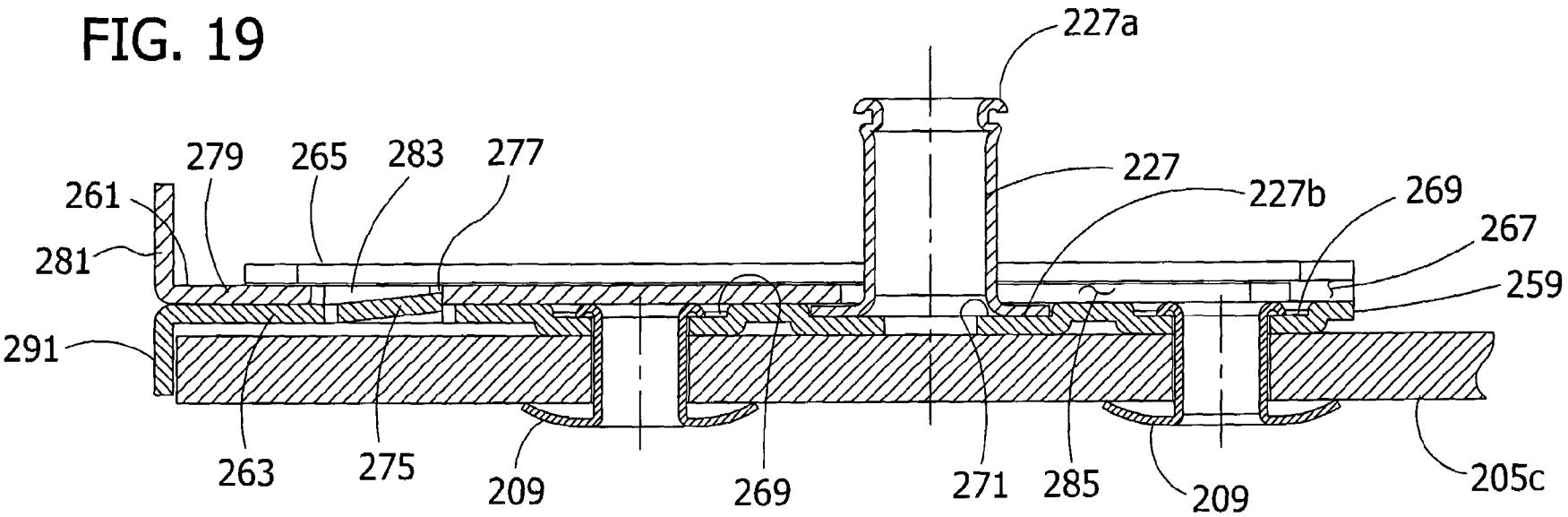
FIG. 19 is a section taken on line 19-19 of FIG. 17.
Figure 21:
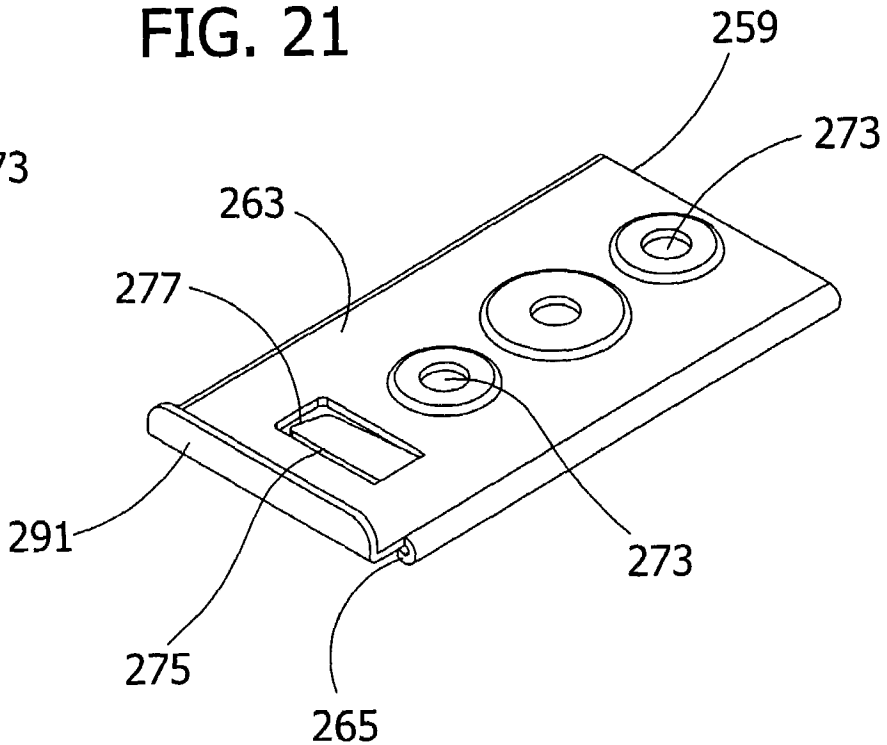
FIG. 21 is a bottom side perspective of the base plate of FIG. 20.
Figure 20:
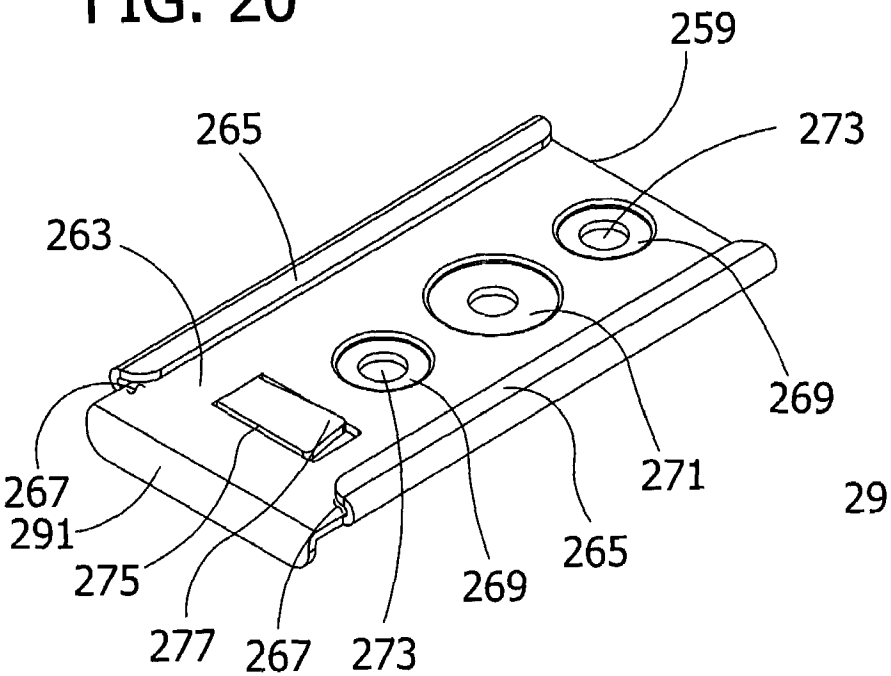
FIG. 20 is an enlarged, top side perspective of the base plate of FIG. 18.

Referring again to FIGS. 6-8, the two mounting posts 27 are located adjacent the levers 13 and space the ring binder mechanism 3 off the cover 5 so that the hinge plates 31 can pivot without engaging the spine 5*c* of the cover. In this position, the mounting posts 27 align with the oval openings 41 of the interconnected hinge plates 31 and pass through the hinge plates without interfering with their operation. Each mounting post 27 is also tubular in shape and includes two open longitudinal ends. A first end includes a deformable lip 27*a* for attaching the mounting post to one of the circular openings 25 in the upper surface of the housing 12 (FIGS. 2 and 13). It will be understood that other ways of attaching the mounting posts 27 to the housing 12 may be used without departing from the scope of the present invention. Referring again to FIGS. 6-8, a second end includes a flange 27*b* that extends radially outward of the mounting post 27 for supporting the ring binder mechanism 3 on the back panel 5*b* of the cover 5. The flange can have other shapes and configurations without departing from the scope of this invention.

Figure 10B:
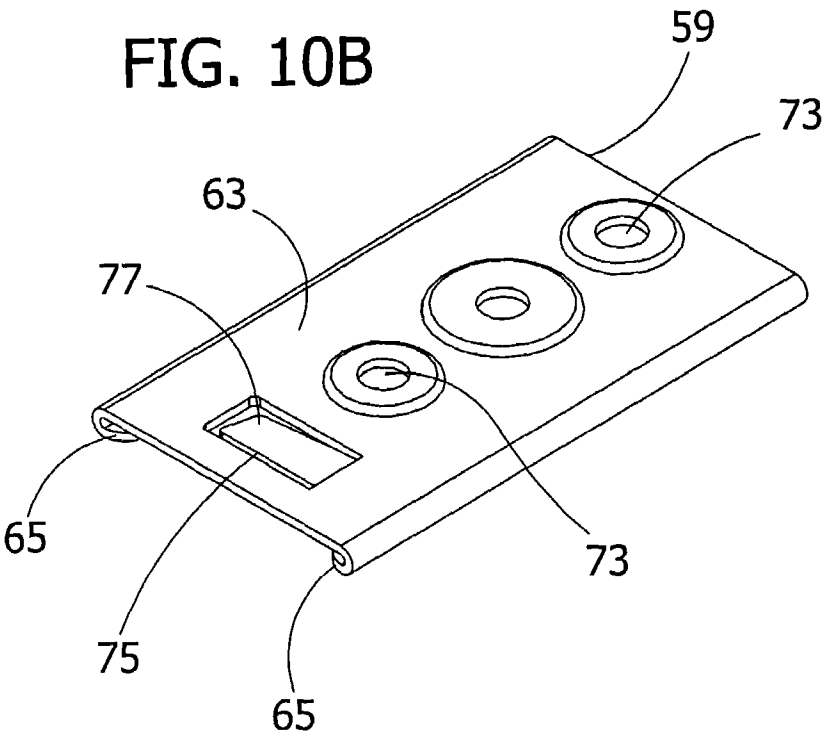
FIG. 10B is a bottom side perspective of the base plate.
Figure 10A:
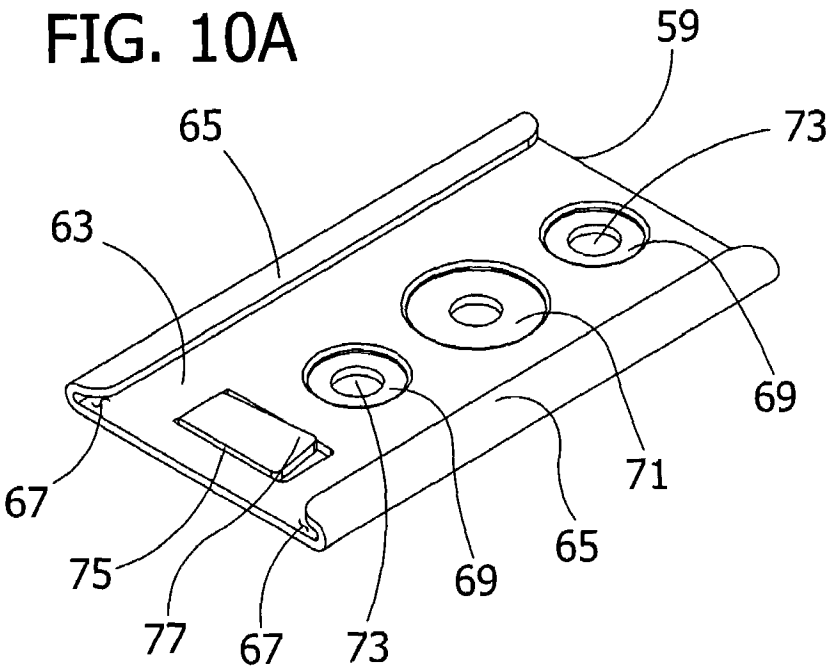
FIG. 10A is an enlarged, top side perspective of the base plate.

As illustrated in FIGS. 1-4, the ring binder mechanism 3 is attached to the spine 5*c* of the cover 5 using the fastening system 6. The fastening system 6 includes two base plates 59 and two keys 61 selectively engagable with respective base plates. Each of the base plates 59 comprises a web 63 and flanges 65 at opposite sides of the web (FIGS. 10A and 10B). Each of the flanges 65 has an in-turned portion at its free edge extending generally toward the other flange and generally parallel to the web 63 to define a channel 67. The web 63 and flanges 65 are formed in the illustrated embodiment from a single-piece of generally flat sheet metal by bending the edges of the piece of sheet metal over to form the flanges. It will be understood that the base plates can be formed in other ways without departing from the scope of the present invention.

Figure 3:
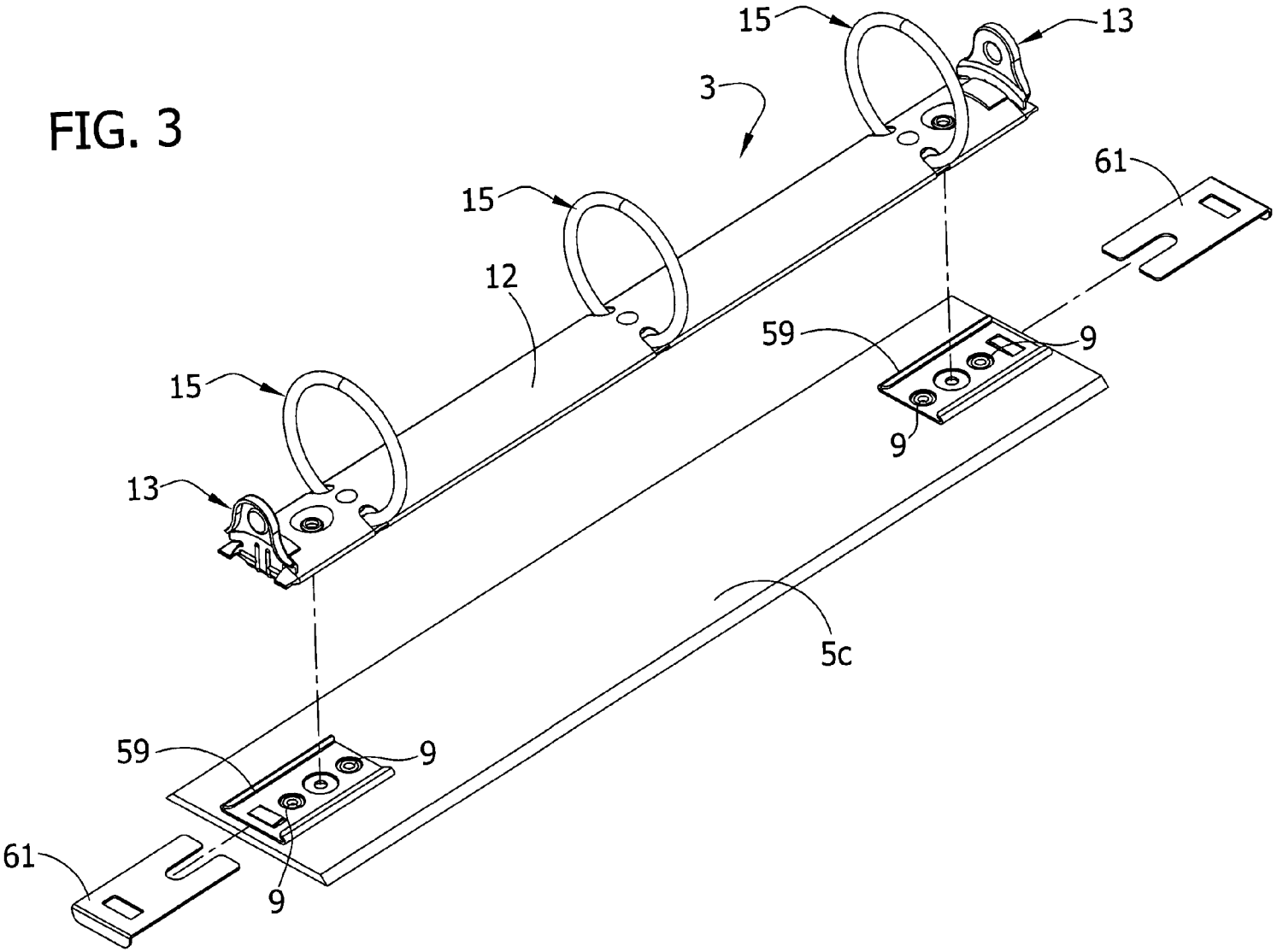
FIG. 3 is an exploded perspective similar to the one shown in FIG. 2 except two base plates are attached to the spine of the cover.
Figure 12:
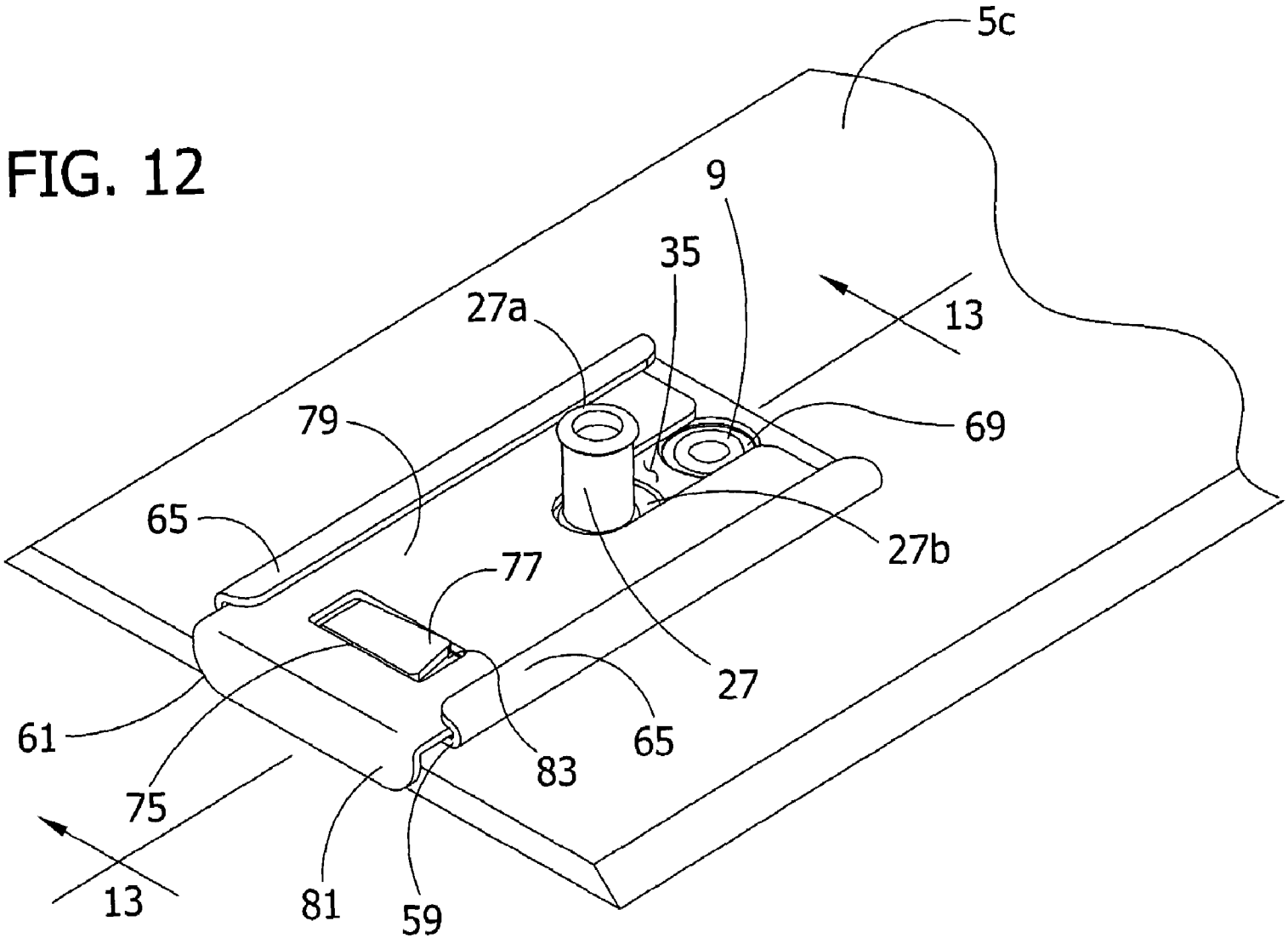
FIG. 12 is a perspective showing the base plate and key cooperating to secure a mounting post of the ring binder mechanism to the spine of the cover.

Each of the base plates 59 also includes three recesses 69, 71. Two of the recesses 69 are smaller than the other recess 71. The two smaller recesses 69 have holes 73 for receiving rivets 9 to attach the base plate 59 to the spine 5*c* of the cover 5 (FIGS. 2 and 3). The holes 73 in the recesses 69 are spaced for aligning with the apertures 7 in the spine 5*c* of the cover 5 so that the rivets 9 can be inserted through the apertures in the spine and the holes in the recesses. The recesses 69 are sized and shaped to accommodate the bent tails 9*a* of the rivets so that substantially no portion of the rivet extends above the surface of the web 63. The larger recess 71, which is positioned between the two smaller recesses 69, is sized and shaped for receiving the flange 27*b* of the mounting post 27 so that substantially no portion of the flange extends above the surface of the web 63 (FIGS. 12 and 13). The base plates 59 further comprise tabs 75 having a generally rectangular shape. In the illustrated configuration, the tabs 75 are cut from the web 63 and portions of the tabs are bent upward to form tongues 77 (broadly, "first locking element"). The tongues 77 are used to secure the keys 61 to the base plates 59 as described in move detail below. The tabs 75 can have shapes besides rectangular (e.g., triangular).

Referring again to FIGS. 2 and 3, each of the base plates 59 are securely attached to the cover 5 in predetermined locations using rivets 9. The locations of the base plates 59 are selected based on the desired location of the ring binding mechanism 3. For example, the base plates 59 can be attached to either the spine 5*c* (as shown), the front panel 5*a*, or the back panel 5*b* of the cover 5. Markings (not shown) can be placed on the cover 5 to identify the locations on the cover where the base plates are to be mounted. The spacing between the base plates 59 is determined based on the distance between the mounting posts 27 on the ring binding mechanism 3. As an illustrative example, the mounting posts 27 of the illustrated ring binding mechanism 3 are spaced about 9.5 inches apart. As a result, the base plates 59 will be spaced such that the portion of the base plates adapted to receive the mounting post 27 (i.e., the larger recesses 71) are also spaced about 9.5 inches apart. The dimensions used in this example are illustrative only and it is understood that the base plates can be spaced apart other distances without departing from the scope of this invention. It is also understood that the ring binder could have more or fewer mounting post and base plates without departing from the scope of this invention.

Figure 11B:
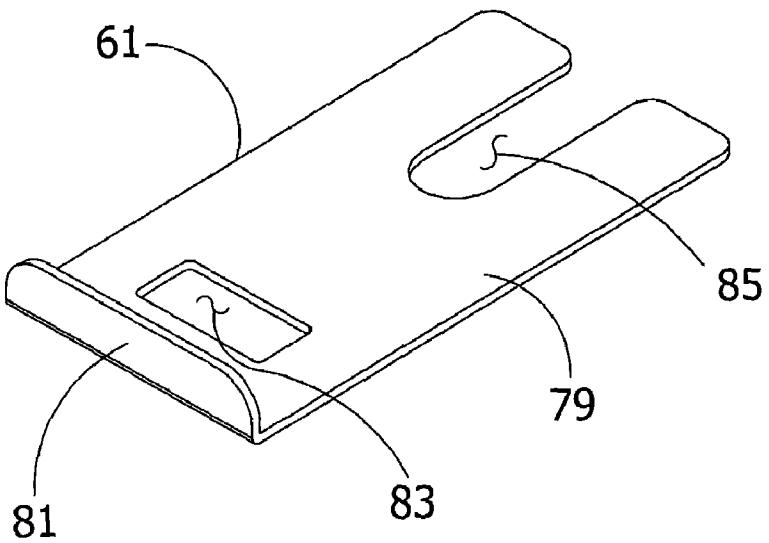
FIG. 11B is a bottom side perspective of the key.
Figure 11A:
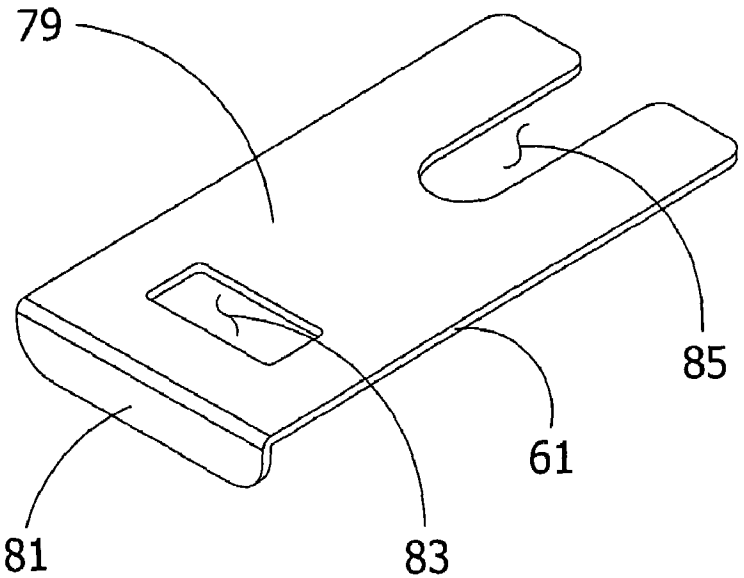
FIG. 11A is an enlarged, top side perspective of a key.

Each of the keys 61, as shown in FIGS. 11A and 11B, comprises a generally rectangular shaped web 79 and a bent downward lip 81. When attached to the base plate 59, the lip 81 provides protection for a portion of the edge of the spine 5*c* of the cover 5. The web 79 of the key 61 also includes a rectangular shaped opening 83 (broadly, "second locking element") that is sized and shaped for receiving the tongue 77 of the base plate 59 for securing the key against movement with respect to the base plate. The interaction of the tongue 77 and the opening 83 is described in more detail below. The key 61 further includes an elongate slot 85 adapted for receiving the mounting posts 27 of the ring binder mechanism 3.

Ring binders 1 of the present invention can be assembled by affixing the base plates 59 to the spine 5*c* of the cover 5 using rivets 9 (FIG. 3), engaging the flanges 27*b* of the mounting posts 27 with the large recesses 71 in the base plates 59 (FIG. 4), and securing the flanges 27*b* in the recesses 71 using the keys 61 (FIG. 1). To affix the base plates 59 to the cover 5 as shown in FIG. 3, the holes 73 in the base plates are aligned with the apertures 7 in the spine 5*c* of the cover. The rivets 9 are inserted through the apertures 7 in the spine 5*c* and the holes 73 in the base plates 59 so that the tails of the rivets extend through the base plates. The tails of the rivets 9 are bent over to thereby secure the base plates 59 to the cover 5. The bent tails 9*a* of the rivets 9 are received in the small recesses 69 so that substantially no portion of the bent tails extend above the surface of the webs 63 of the base plates 59.

Figure 4:
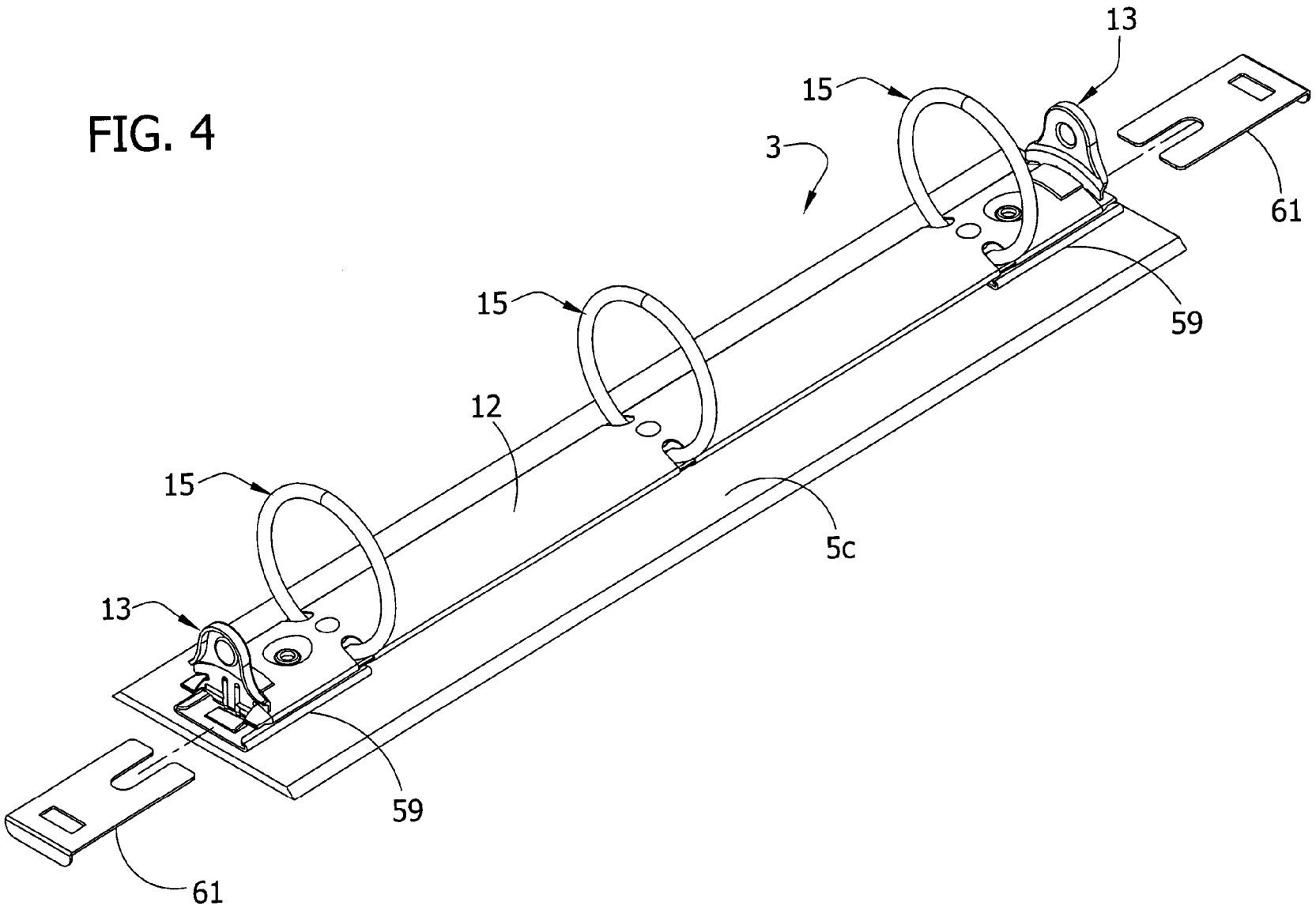
FIG. 4 is a perspective similar to the one in FIG. 3 except the ring binder mechanism is shown engaging the base plates.
Figure 5:
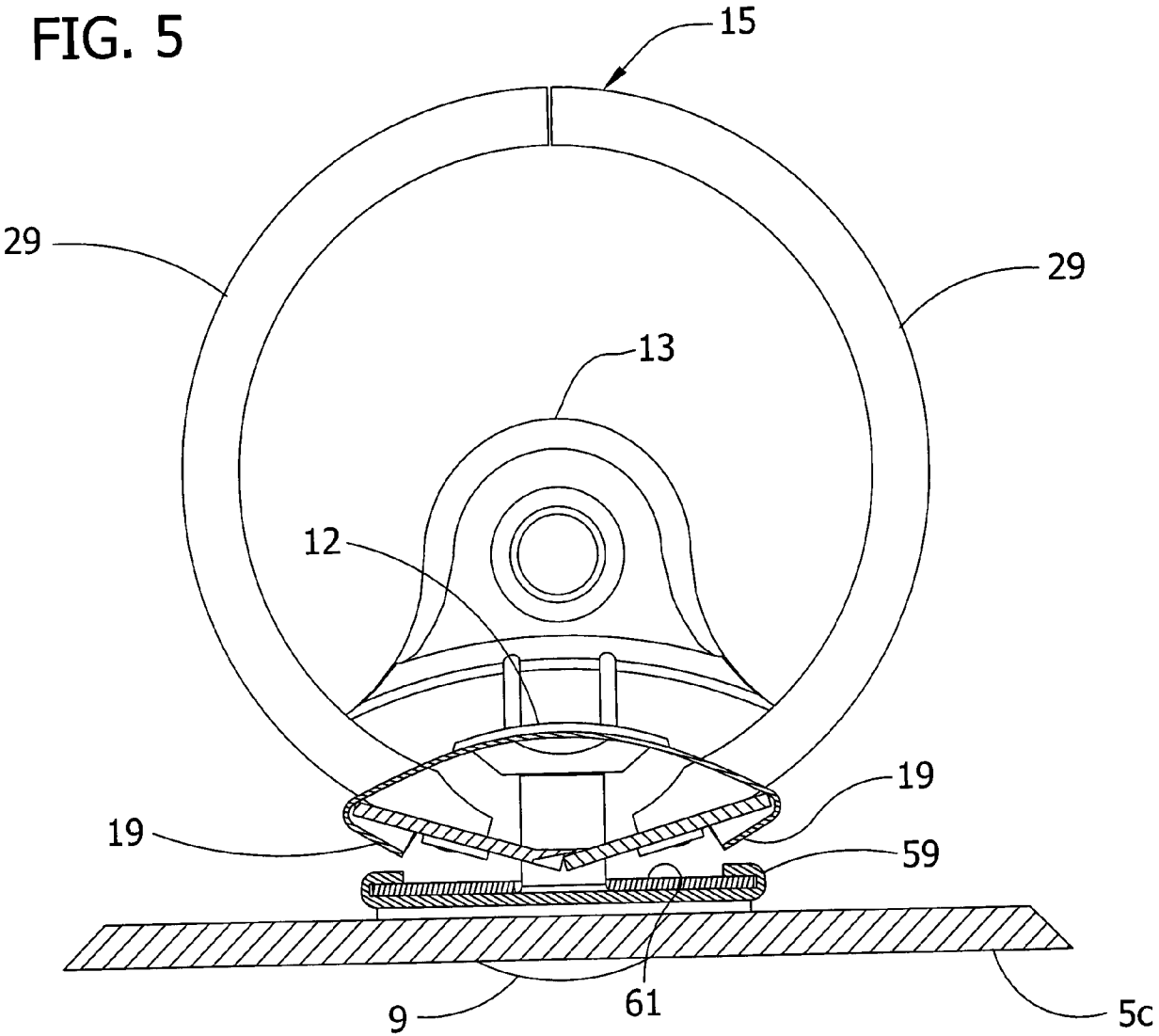
FIG. 5 is a section taken on line 5-5 of FIG. 1.

Referring now to FIG. 4, the flanges 27*b* of the mounting posts 27 of the ring binder mechanism 3 are placed in the large recesses 71 of the base plates 59. The recesses 71 receive the flanges 27*b* so that substantially no portion of the flanges extends above the surface of the webs 63. As a result, the keys 61 can easily be slid into engagement with the base plates 59 and the mounting posts 27. Referring to FIGS. 1, 12 and 13, the lateral edges of the webs 79 of the keys 61 are received in respective channels 67 of the base plates 59 and the tongues 77 of the base plates are received in the openings 83 in the keys. Each of the tongue 77, as shown in FIG. 13, is sloped with respect to the web 63 of the base plate 59 so that the tongue provides a ramped surface for allowing the web 79 of the key 61 to pass over the tongue. Moreover, the tongue 77 is resiliently deformable so that it deflects downward (i.e., toward the cover 5) as the web 79 of the key 61 passes over the base plate 59. Once a trailing edge 77*a* of the tongue 77 passes a leading edge 83*a* of the opening 83 in the key 61, the tongue returns to approximately its original shape so that the tongue extends upward (i.e., away from the cover 5) and into the opening. The trailing edge 77*a* of the tongue 77 acts as a stop against the leading edge 83*a* of the opening 83 to prevent the key 61 from being disengaged from the base plate 59.

The elongate slots 85 of the keys 61 allow the keys to slide past the tubular body of the mounting posts 27. When the keys 61 and base plates 59 are engaged, the tubular bodies of the mounting posts 27 are received in the slots 85. With the keys 61 secured to the base plates 59, as illustrated in FIGS. 12 and 13, the flanges 27*b* of the mounting posts 27 are secured between the base plates and the edges of the keys 61 defining the elongate slots 85 thereby securing the ring binder mechanism 3 to the cover 5. The steps for assembling the ring binder mechanism with the cover can be reversed to disassemble the ring binder (i.e., remove the ring binder mechanism 3 from the cover 5). To remove the keys 61 from engagement with the base plates 59, however, the tongues 77 need to be deflected downward using an object (not shown) so that leading edges 83*a* of the openings 83 can be passed over trailing edges 77*a* of the tongues. As illustrated in FIG. 1, the tongues 77 are located adjacent the lever 13 and can be readily accessed using the tool.

Accordingly, ring binders of the present invention can be packaged, shipped, stored and/or sold without having the ring binder mechanism 3 attached to the cover 5. For example, the covers 5 with the base plates 59 attached thereto can be packaged such that little space between adjacent covers is wasted. This can be done by laying the covers 5 flat such that the front panel 5*a*, back panel 5*b*, and spine 5*c* are all substantially in the same plane and stacking others on top. The ring binder mechanisms 3 can be packaged in the same container as the covers 5 or separately. Either way, the ring binder mechanism 3 can be arranged to minimize wasted space. One possible packing arrangement for the ring binder mechanisms 3 is to pack them in alternating directions such that the rings 15 of one mechanism are positioned between the rings of an adjacent mechanism. The keys 61 can be packaged with the cover (either attached to the base plates 59 or separately), packaged with the ring binder mechanisms 3 or packaged in a separate container. The separated covers 5 and ring binder mechanisms 3 can be packaged, shipped, and stored more efficiently and cost effectively than covers having the ring binder mechanisms attached.

The ring binder mechanism 3 and covers 5 can be attached, for example, by the retailer prior to transferring them to a customer (i.e, after a sale) or before placing them on display. It is also understood that the customer may wish to maintain the ring binder mechanism 3 and covers 5 separately to take advantage of the saved storage space. Thus, the customer may be the one who attaches the ring binder mechanism 3 to the cover 5. Accordingly, it is understood that the ring binder mechanism 3 and cover 5 of the present invention can be joined to form a ring binder 1 at any of various times. The examples of the ring binder mechanism 3 being attached to the cover 5 by a retailer and an end user are exemplary only as it is understood that other individuals, including the ring binder manufacturer, may assemble the ring binder. It is also understood that the ring binder mechanism could be attached to the cover using an automated process as well as the manual process described herein.

FIGS. 14-18 show another configuration of a key 161 substantially similar to the previous described key 61 except that a lip 181 extends upward from the web 179 of the key to provide a grip for gripping the key while engage and disengage the key with a base plate 159. Corresponding parts of the ring binder of FIGS. 14-18 are indicated by the same reference numbers used for the ring binder shown in FIGS. 1-13 plus "100".

Figure 22B:
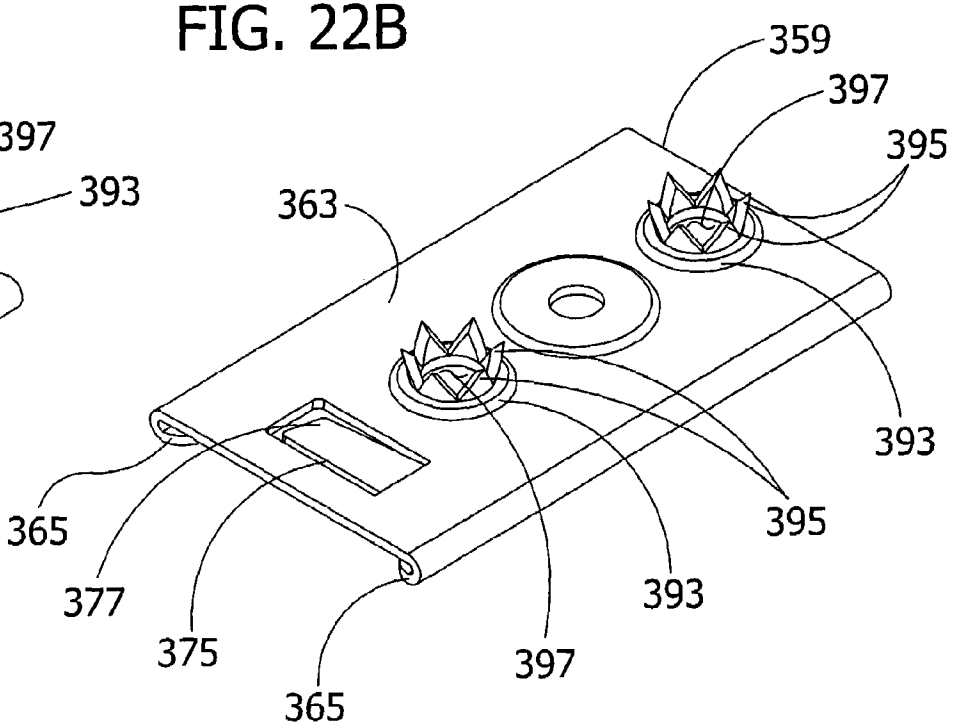
FIG. 22B is a bottom side perspective of the base plate of FIG. 22A.
Figure 22A:
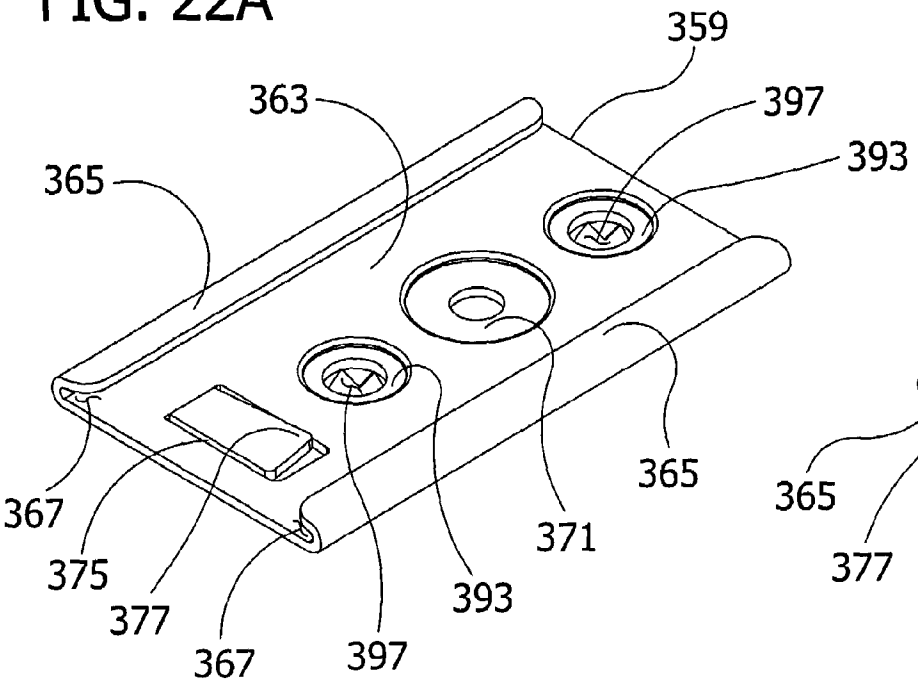
FIG. 22A is an enlarged, top side perspective of a base plate of another configuration.
Figure 23:
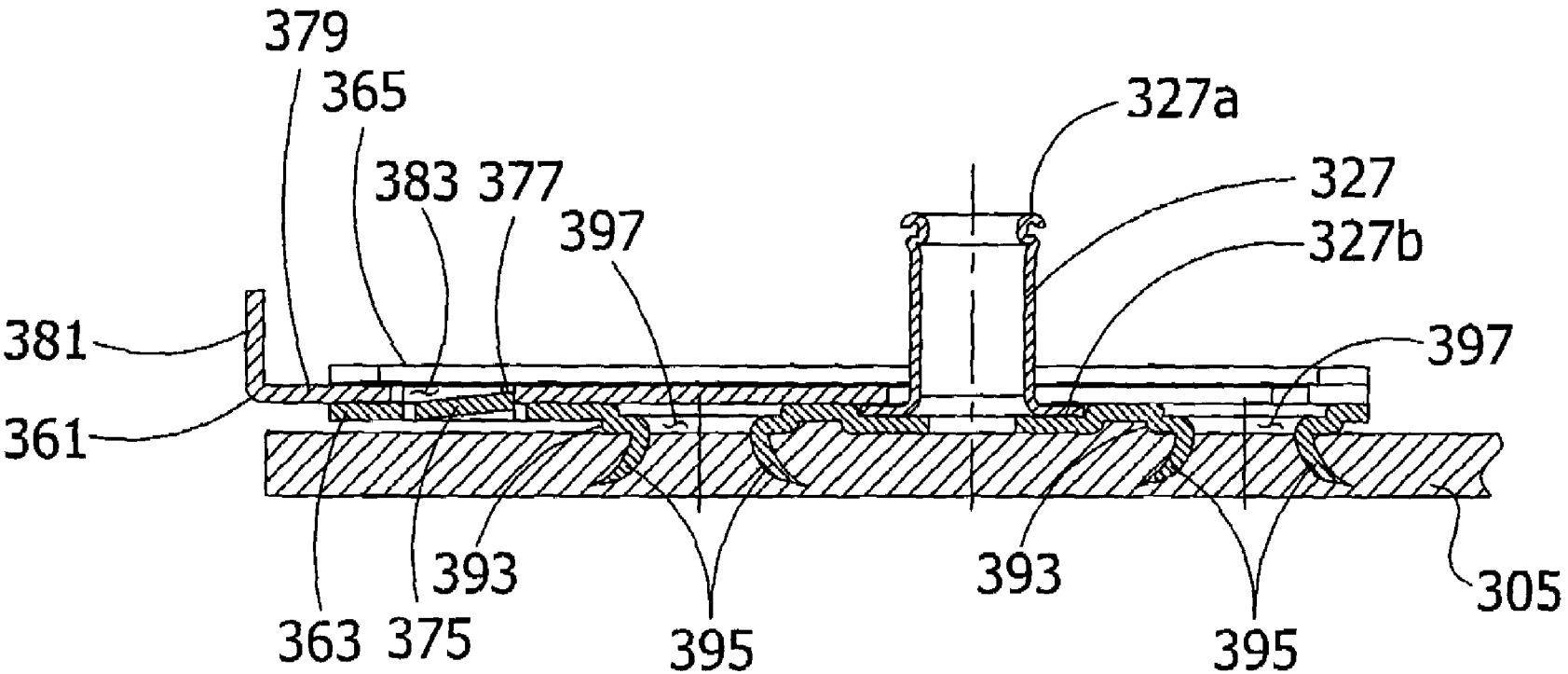
FIG. 23 is a section similar to FIG. 19 but showing the base plate of FIG. 22A.

FIGS. 17-21 show a configuration of a base plate 259 that is substantially similar to the previous described base plate 59 except that the base plate 259 of this configuration has a lip 291 that extends downward from the web 263 of the base plate for protecting a portion of an edge of a cover 205. Corresponding parts of the ring binder of FIGS. 17-21 are indicated by the same reference numbers plus "200". FIGS. 22A-23 show yet another configuration of a base plate 359 that is substantially similar to the base plate 59 shown in FIGS. 1-16 except that the base plate 359 of this configuration is affixed to a cover 305 using a prong fastener 393 instead of rivets. In the illustrated configuration, two prong fasteners 393 extend outwardly from the bottom surface of the base plate 359 and are used to secure each of the plates to the notebook 305. Each prong fastener 393 has six, generally triangular prongs 395 struck from the base plate 359 leaving a circular opening 397. As illustrated in FIG. 23, the prongs 395 can be pressed into the notebook 305 to effect the fastening of the base plate 359 to the notebook. The bottom surface of the base plates can have more or fewer prong fasteners. Corresponding parts of the ring binder of FIGS. 22A-23 are indicated by the same reference numbers plus "300".

Figure 28:
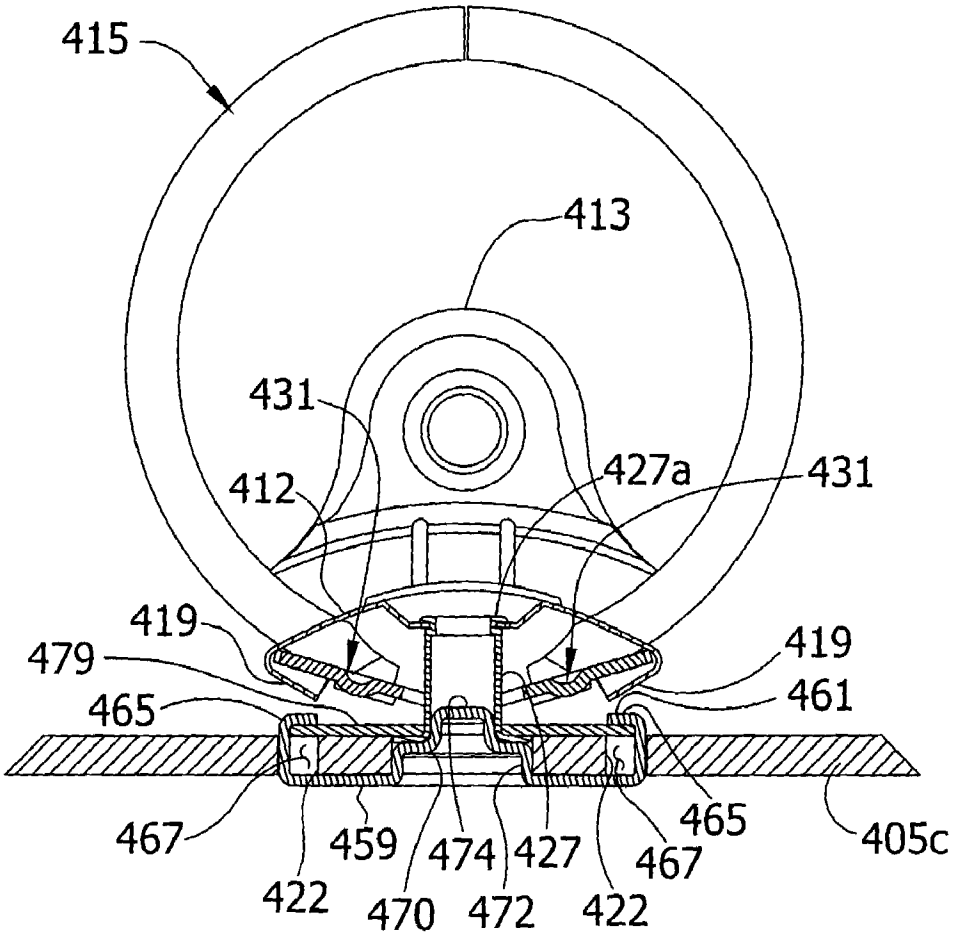
FIG. 28 is a section along line 28-28 of FIG. 24.
Figure 29:
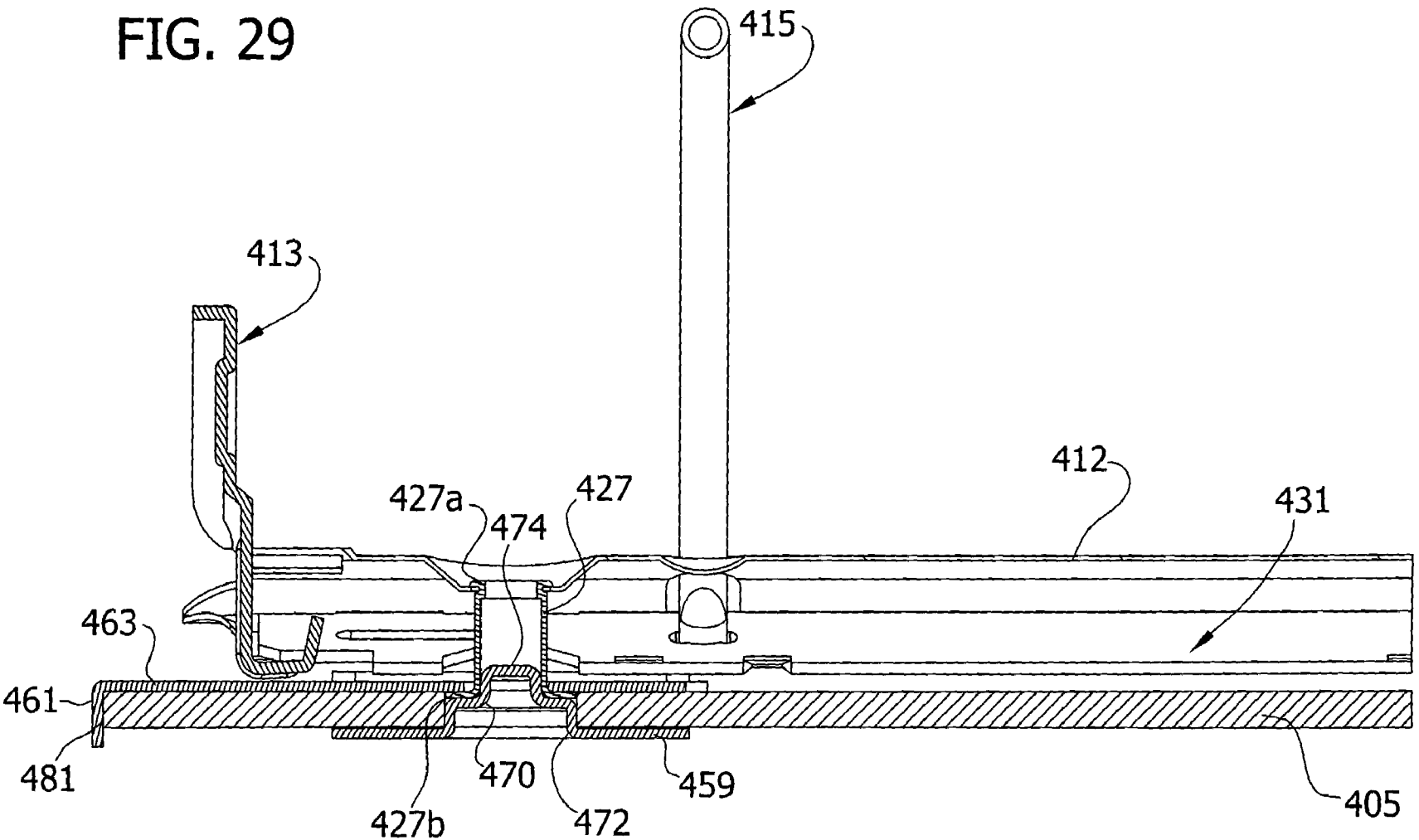
FIG. 29 is a section along line 29-29 of FIG. 24.
Figure 30:
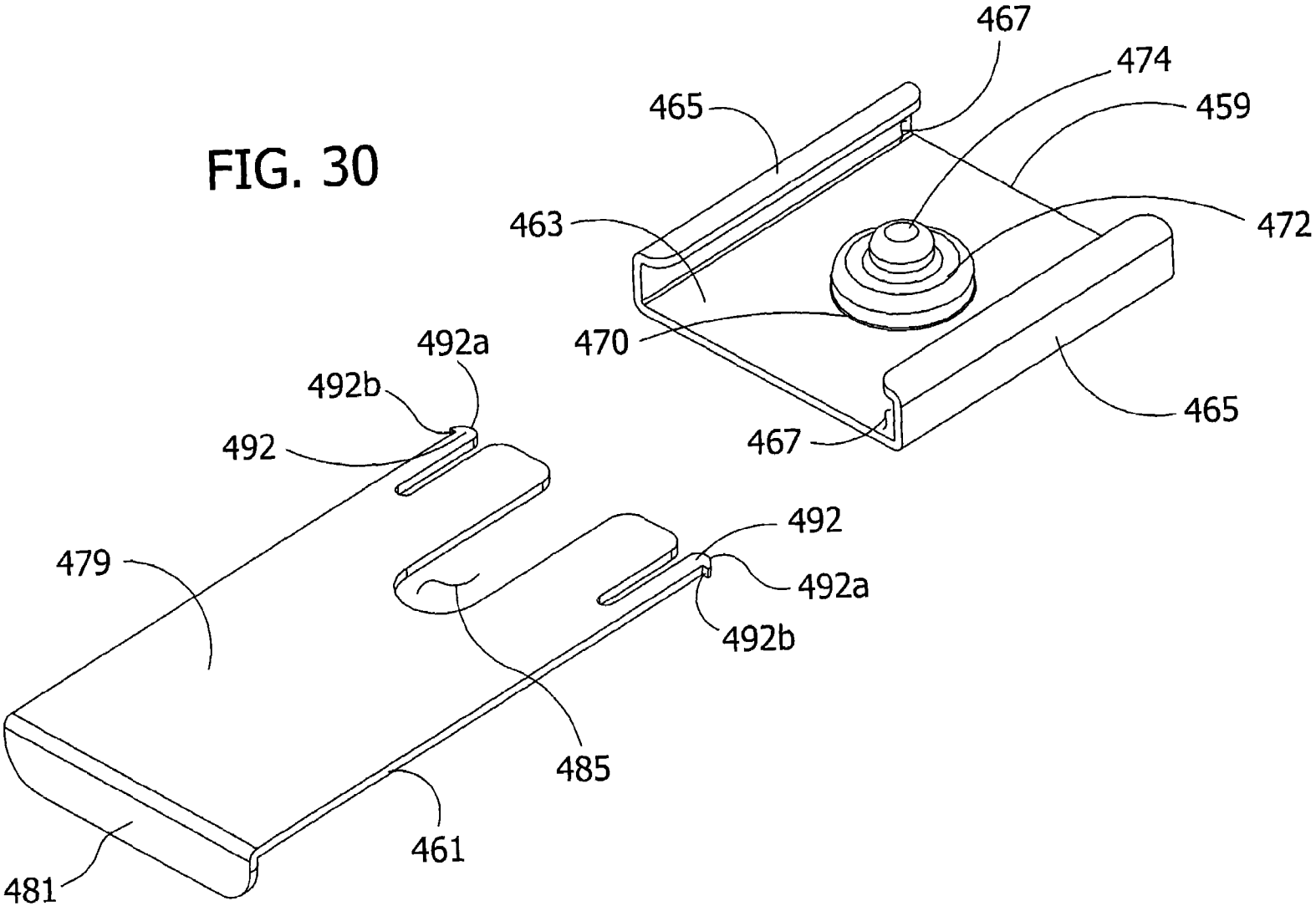
FIG. 30 is an enlarged perspective of a key disengaged from the base plate.

Another configuration of a fastening system 406 of the present invention is shown in FIGS. 24-31 for mounting a ring binder mechanism 403 to a cover 405. Corresponding parts of the ring binder of FIGS. 24-31 are indicated by the same reference numbers plus "400". The fastening system 406 includes two base plates 459 and two keys 461 selectively engagable with respective base plates. Referring to FIG. 30, each of the base plates 459 comprises a web 463 having flanges 465 at opposite sides of the web. Each of the flanges 465 has an in-turned portion at its outer edge extending generally toward the other flange and generally parallel to the web 463 to define a channel 467. Each base plate 459 also includes a protrusion 470 extending upwardly from approximately the center of the web 463. The protrusion 470 has a base 472 and a top 474, which has a diameter less than the diameter of the base.

Each of the keys 461, as also shown in FIG. 30, comprises a generally rectangular shaped web 479 having a bent downward lip 481. When attached to the base plate 459, the lip 481 provides protection for a portion of the edge of the cover 405 to which the base plate is attached. Each key 461 further includes an elongate slot 485 adapted for receiving a mounting posts 427 of the ring binder mechanism 403. Two smaller slots 486 extend adjacent and generally parallel to the longitudinal edge of the web 479 of each key 461. Located at the end of each of the longitudinal edges of the web 479 and near the slots 486 is a hook 492 having a curved surface 492*a* and a generally flat surface 492*b*.

Figure 27:
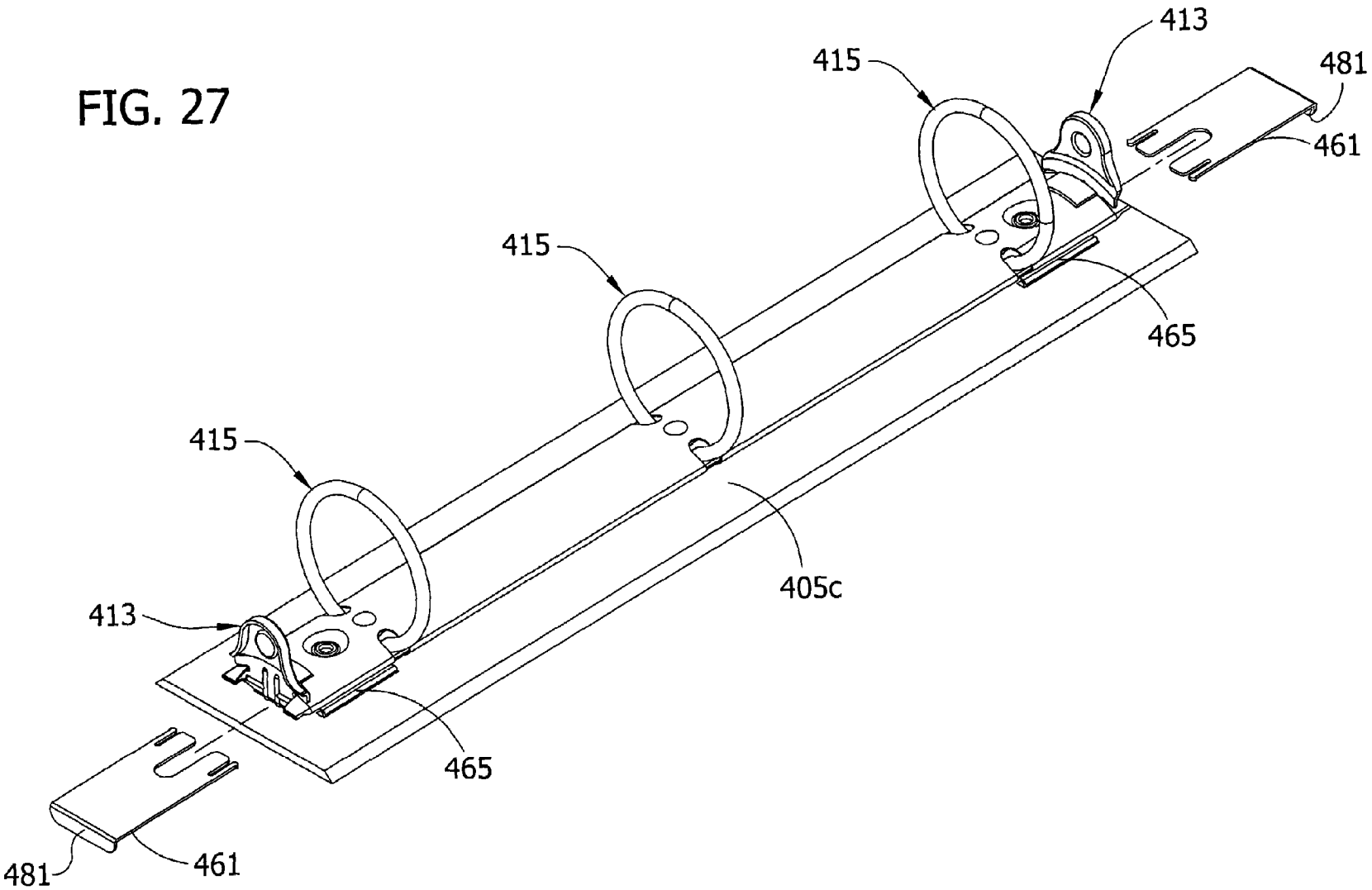
FIG. 27 is a perspective similar to FIG. 26 but showing the ring binder mechanism engaging the base plate.

FIGS. 25, 26, 28, and 29 illustrate how the base plates 459 are affixed to the cover 405. The cover 405 and in particularly, a spine 405*c* of the cover has two elongate openings 422 for receiving the flanges 465 of each of the base plates 459 and a circular opening 424 for receiving the protrusion 470 of each of the base plates. Flanges 427*b* of the mounting posts 427 of the ring binder mechanism 403 are placed in engagement with the protrusions 470 (FIGS. 27-29). The mounting post flanges 427*b* are in face-to-face contact with the bases 472 of the protrusions 470 and the tops 474 of the protrusions extend upward into the bodies the mounting posts 427.

The keys 461 can easily be slid into engagement with the base plates 459 and the mounting posts 427. The lateral edges of the webs 479 of the keys 461 are received in the channels 467 of the base plates 459. The slots 486 provide the necessary flexiability in the webs 479 of the keys 461 for allowing the hooks 492 to pass through the channels. The curved surfaces 492*a* of the hooks 492 engage and slide along the interior surfaces of the base plate flanges 465 as the keys 461 are being inserted in the base plates 459. Once the hooks 492 are passed beyond the extent of the flanges 465, the hooks snap back to about their original position thereby causing the flat surfaces 492*b* of the hooks to be in face-to-face relation with the edges of the flanges 465 to thereby lock the key 461 to the base plate 459 (FIG. 31).

Figure 24:
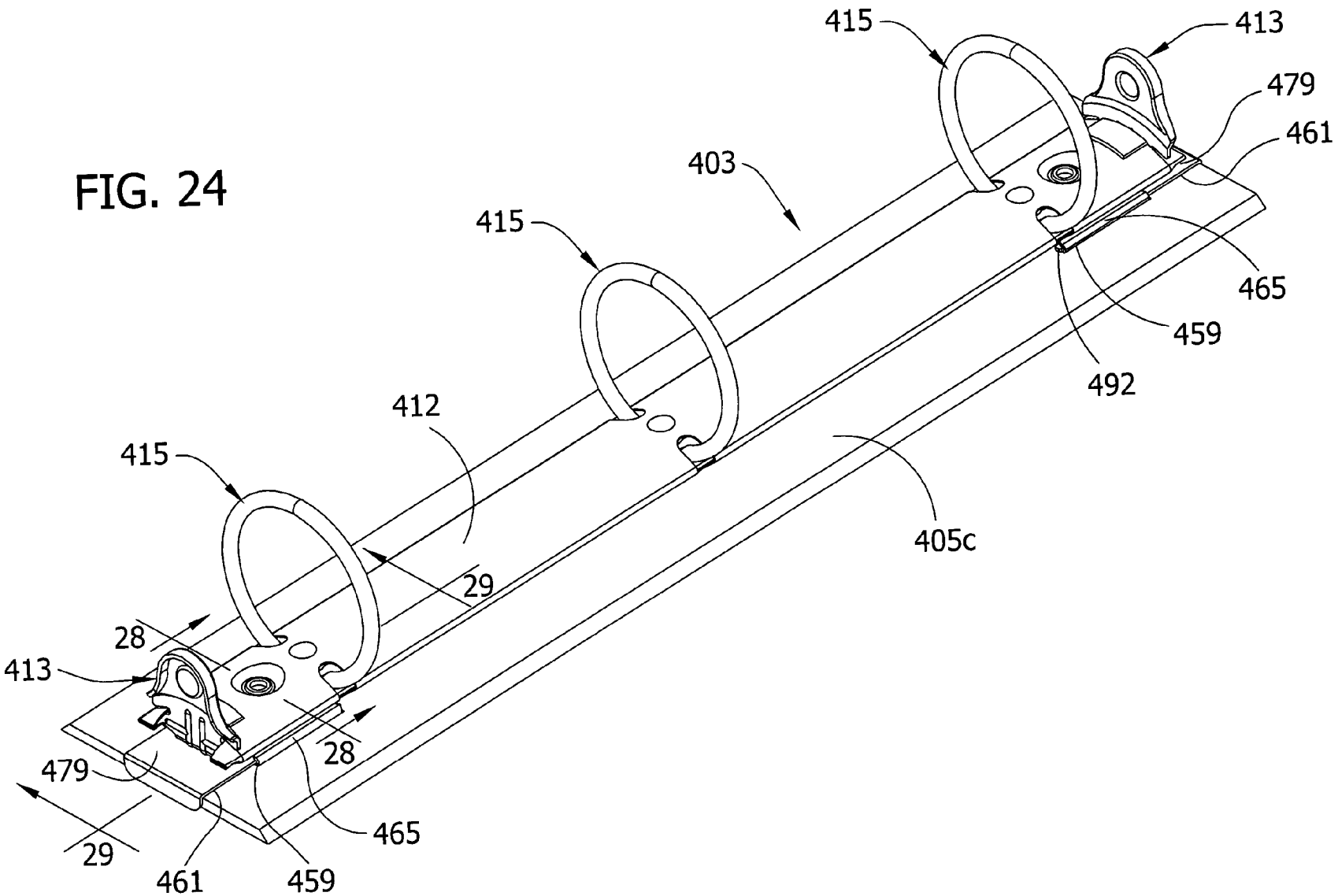
FIG. 24 is a perspective of a ring binder mechanism and ring binder spine having a fastening system of still another configuration.
Figure 25:
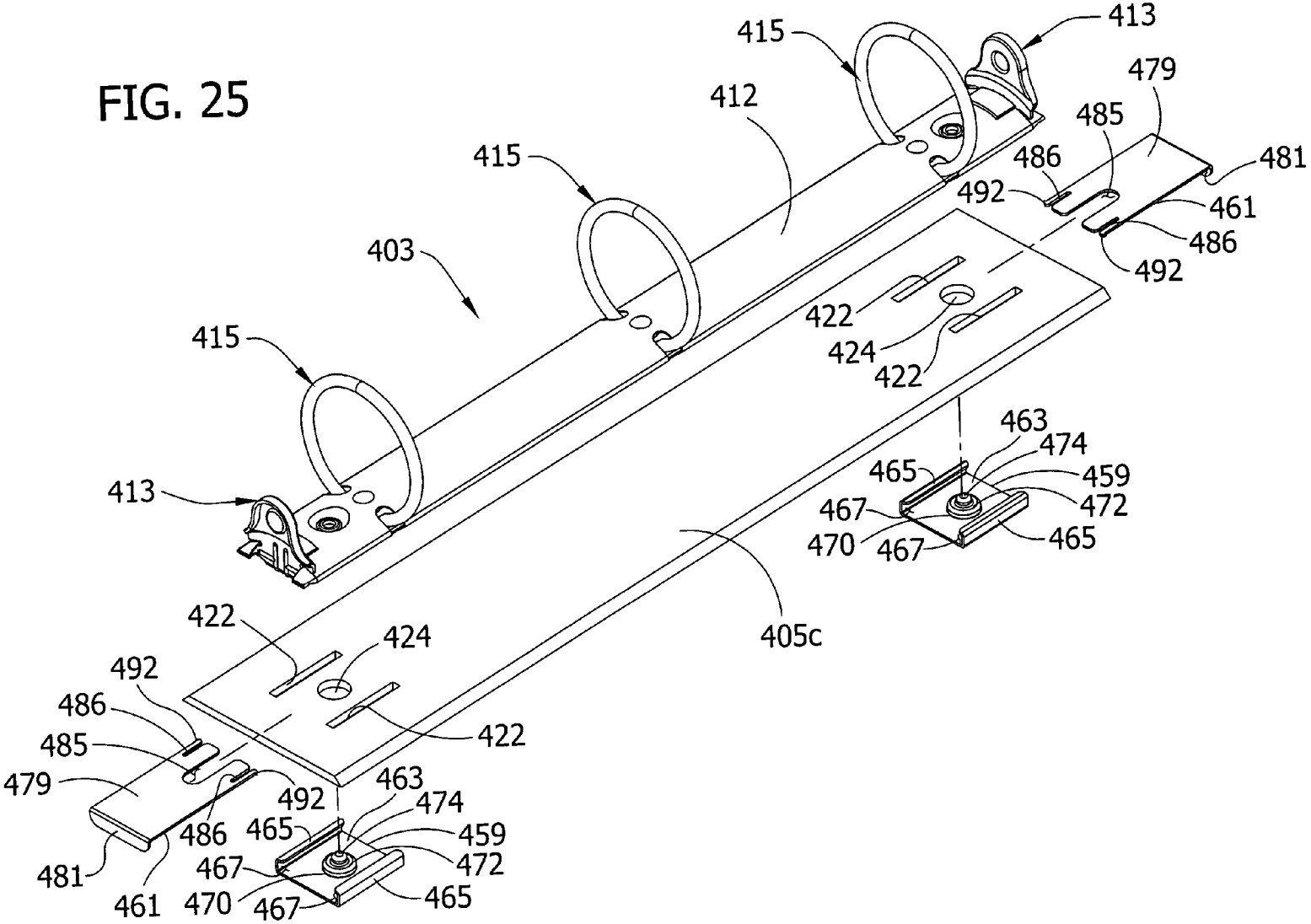
FIG. 25 is an exploded perspective of FIG. 24.
Figure 26:
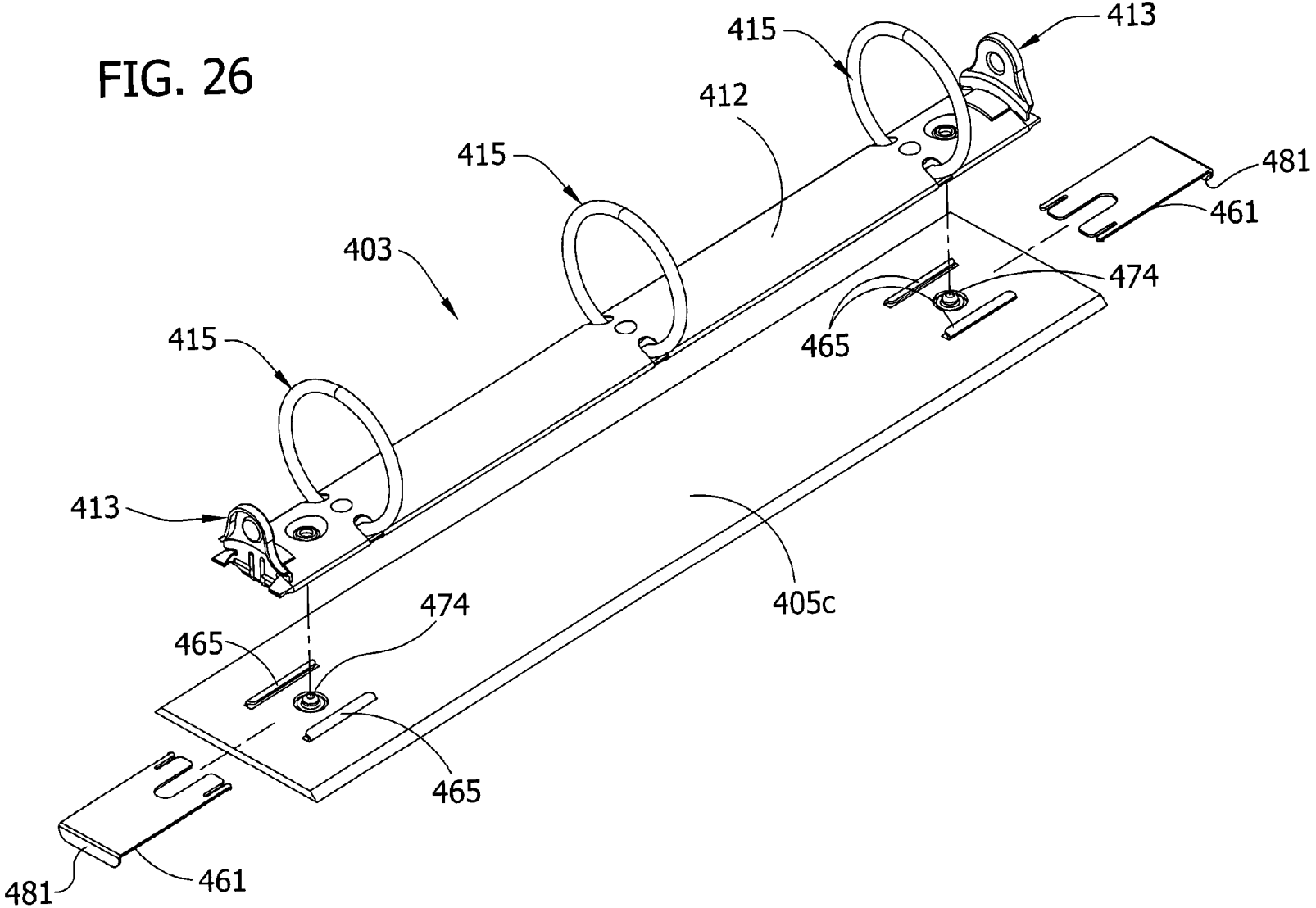
FIG. 26 is a perspective similar to FIG. 25 but showing a base plate attached to the spine of the cover.
Figure 31:
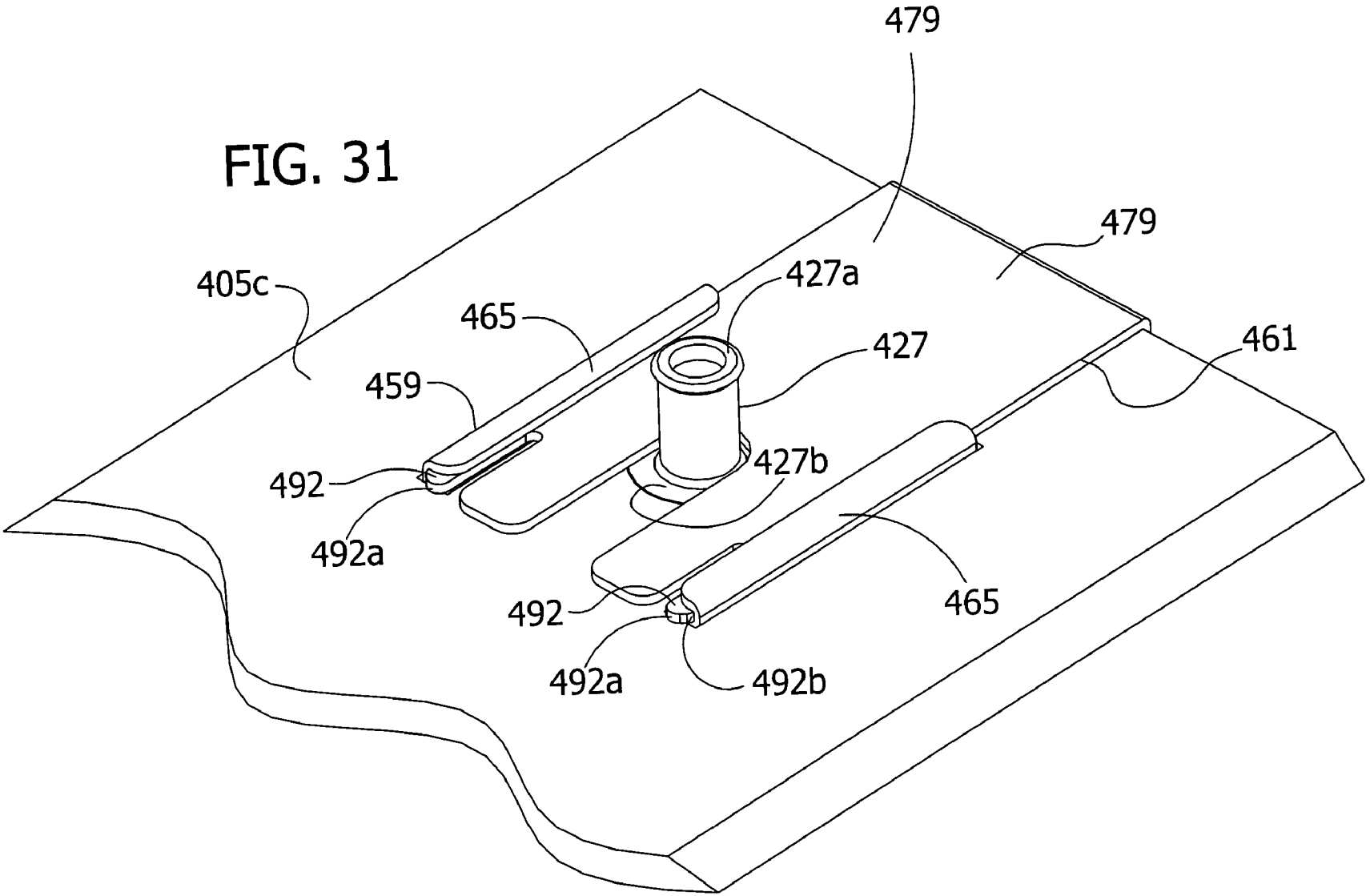
FIG. 31 is a perspective showing the base plate and key cooperating to secure a mounting post of the ring binder mechanism to the spine of the cover.

With the keys 461 secured to the base plates 459, as illustrated in FIGS. 24 and 31, the flanges 427*b* of the mounting posts 427 are securely held between keys and the base plates thereby securing the ring binder mechanism 403 to the cover 405. The steps for assembling the ring binder can be reversed to disassemble the ring binder 401 (i.e., remove the ring binder mechanism 403 from the cover 405). To remove the keys 461 from engagement with the base plates 459, however, the hooks 492 need to be squeezed towards each other so that flat surfaces 492*b* of the hooks are no longer in face-to-face relation with the edges of the base plate flanges 465 to thereby allow the keys to be slid back through the channels 467 in base plates.

Figure 32:
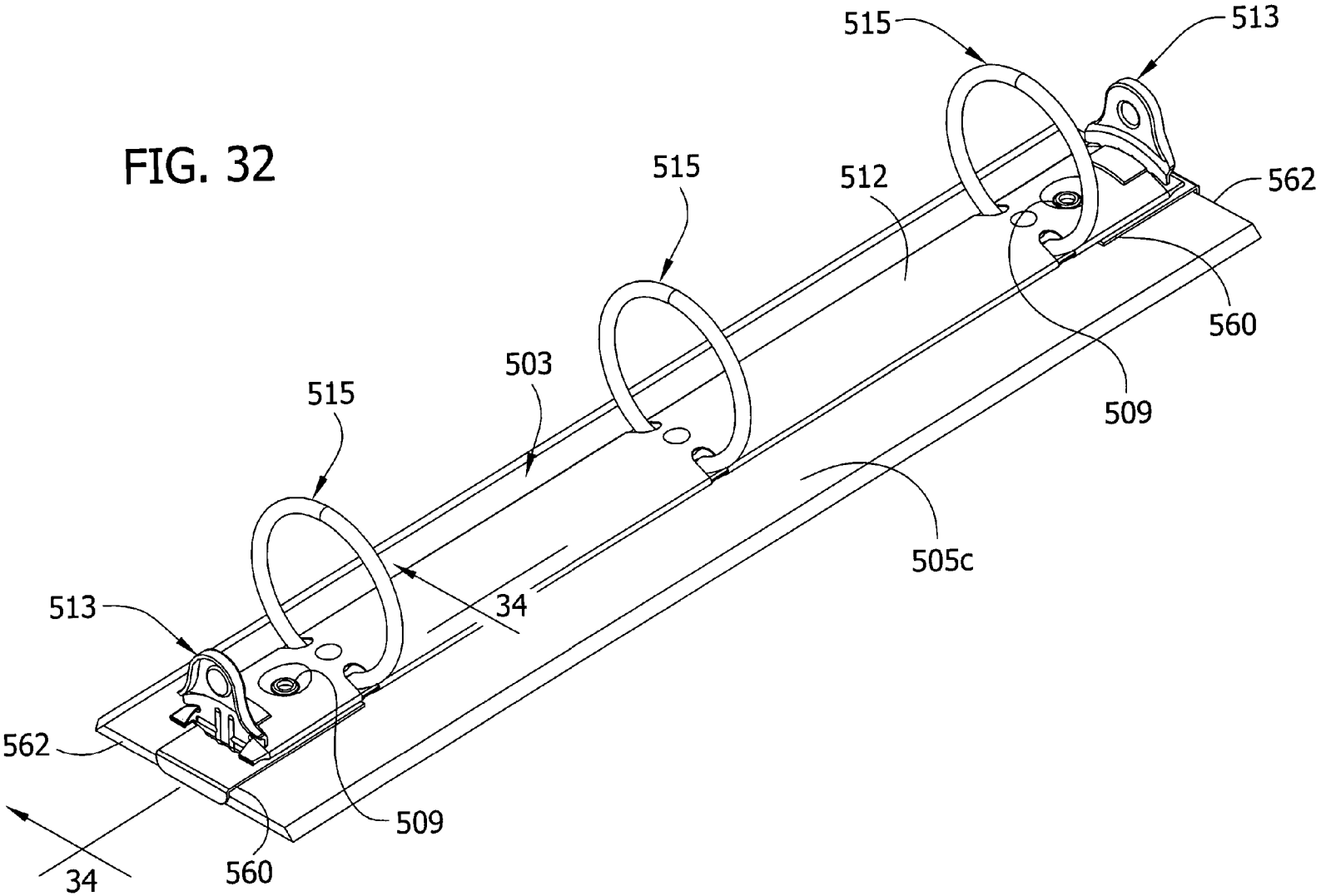
FIG. 32 is a perspective of a ring binder mechanism attached to a spine of a cover and an edge protector.
Figure 33:
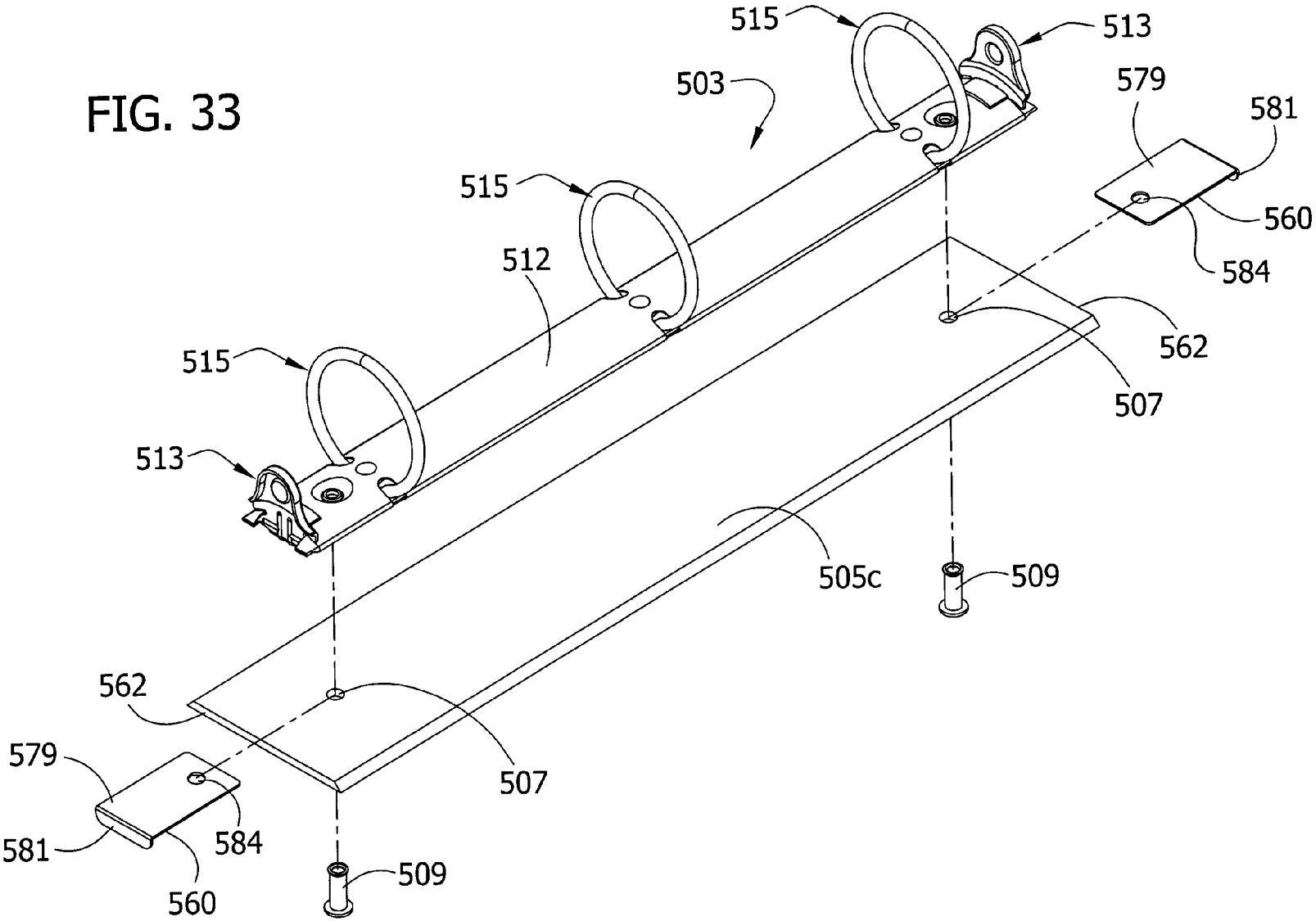
FIG. 33 is an exploded perspective of FIG. 32.
Figure 34:
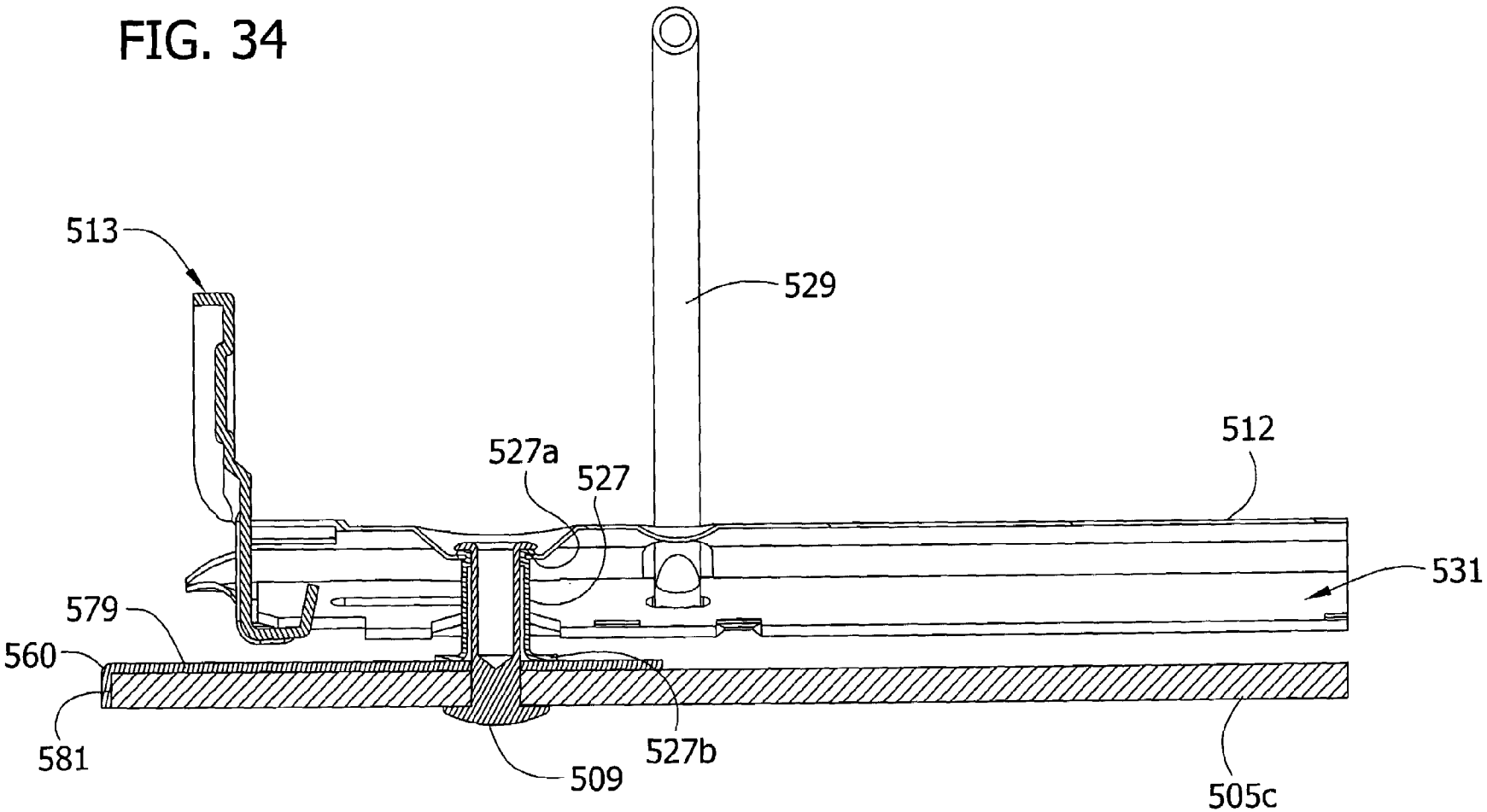
FIG. 34 is a section along line 34-34 of FIG. 32.

With reference now to FIGS. 32-34, a binder mechanism 503 is shown mounted on a spine 505*c* of a ring binder ring cover using two rivets 509. A front panel and a back panel of the ring binder cover are not shown but are substantially the same as the font and back panels 5*a*, 5*b* shown in FIG. 1. As shown in FIG. 2, the spine 505*c* of the cover includes two apertures 507 for receiving the rivets 509 used to mount the ring binder mechanism 503 to the spine. The ring binder mechanism 503 is substantially the same as the ring binder mechanism 3 shown in FIGS. 1-13. As a result, the ring binder mechanism 503 will not be described in detail. Corresponding parts of the ring binder mechanism 503 are indicated by the same reference numbers used for the ring binder mechanism shown in FIGS. 1-13 plus "500".

Two edge protectors 560 for protecting edges 562 of the spine 505*c* are also mounted on the spine using the rivets 509. Each of the edge protectors includes a generally rectangular shaped web 579 and a bent downward lip 581. When mounted on the spine 505*c*, the lips 581 of the edge protectors 560 provide protection for portions of the edges 562 of the spine 505*c*. The webs 579 of the edge protectors 560 also include circular openings 584 sized and shaped for receiving rivets 509 for securing the edge protectors to the spine 505*c*. As illustrated in FIG. 34, the edge protectors 560 are disposed between a flange 527*b* of a mounting post 527 and the spine 505*c*. It is understood that the edge protectors 560 can be mounted on the spine 505*c* in different ways including independently of the ring binder mechansim.

Figure 35:
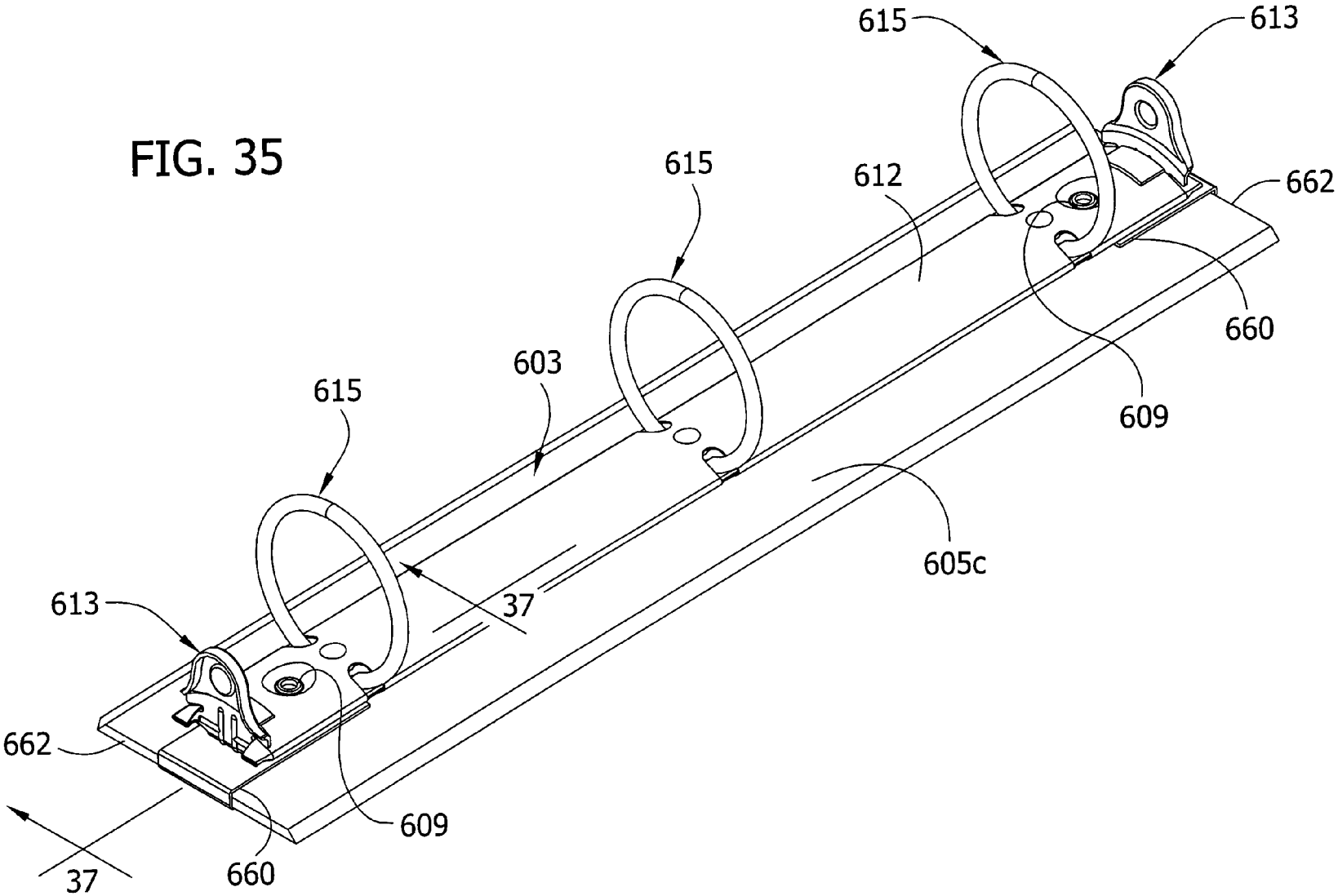
FIG. 35 is a perspective showing a ring binder mechanism attached to a spine of a cover and another configuration of an edge protector.
Figure 36:
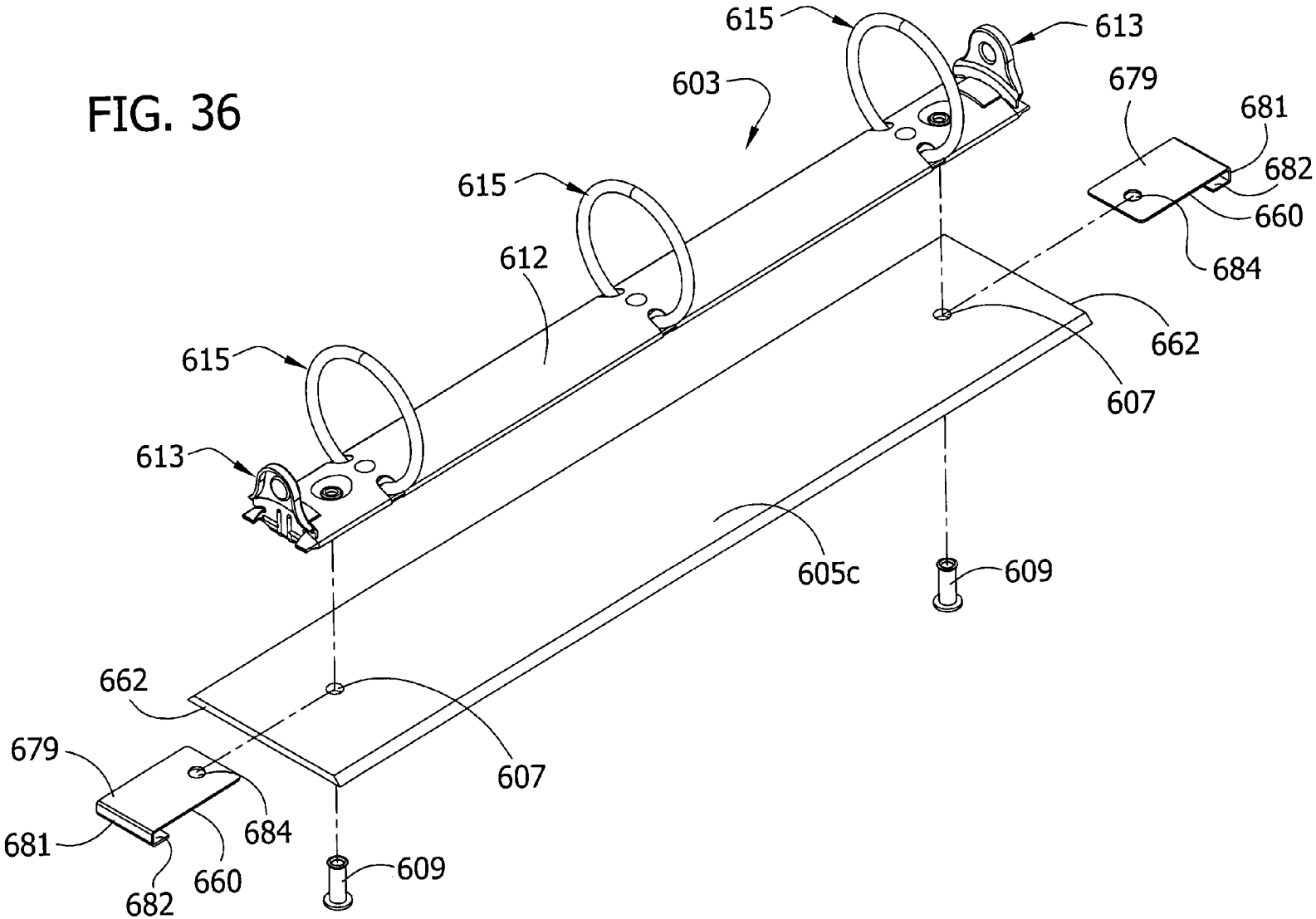
FIG. 36 is an exploded perspective of FIG. 35.
Figure 37:
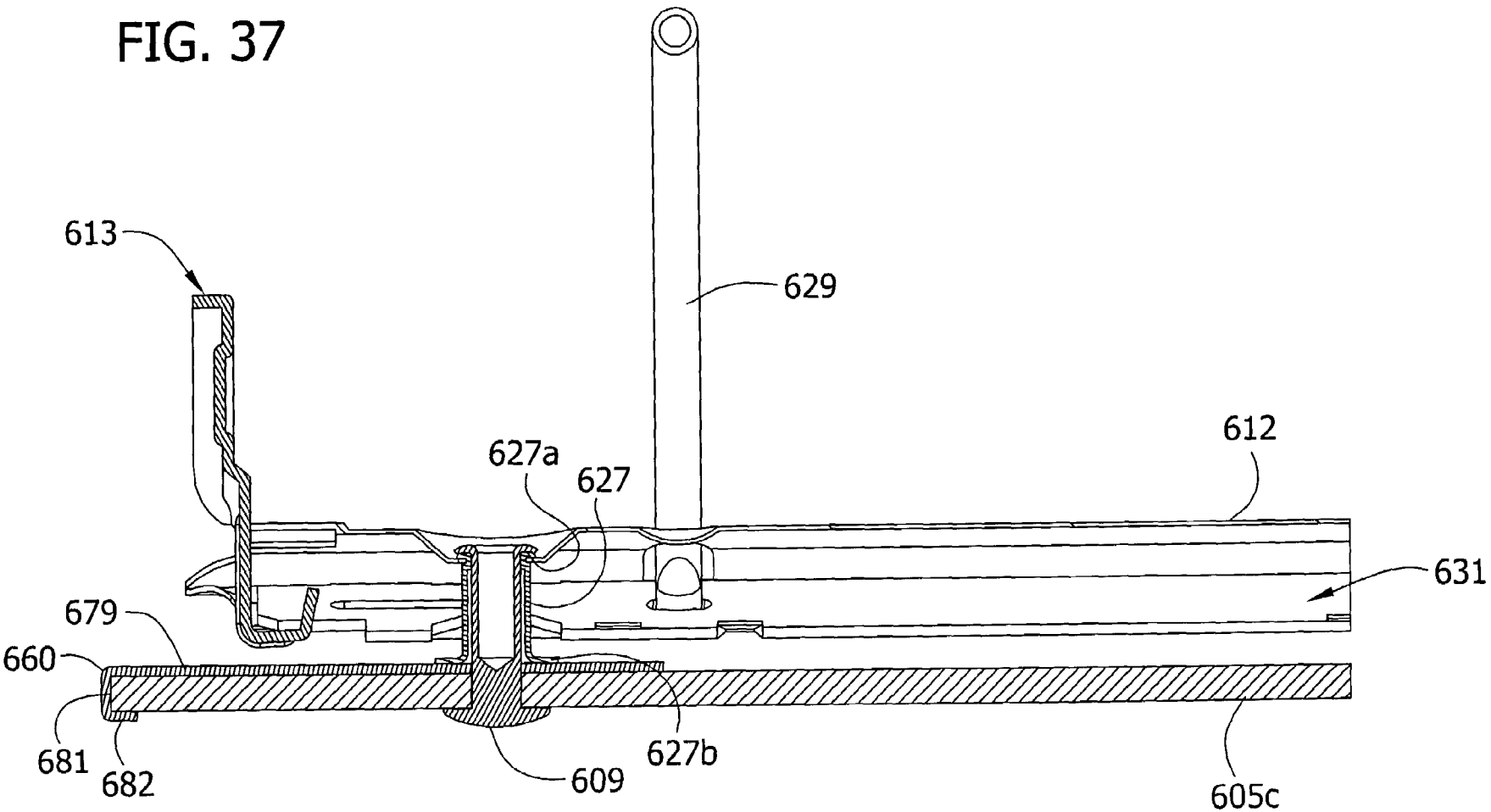
FIG. 37 is a section along line 37-37 of FIG. 35.

FIGS. 35-37 show another configuration of an edge protector 662. The edge protectors 662 of this configuration are substantially similar to edge protector 562 shown in FIGS. 32-34 except a flange 682 extends outwardly from a lip 681. The flange 682 extends generally parallel to but a shorter distance than a web 679 of the end protector 662. It is understood, however, that the flange 682 may extend a distance equal to or greater than the web 682. Parts corresponding to those shown in FIGS. 32-34 are identified using the same reference numbers plus 100.

Components of the mechanism of the present invention are made of a suitable material, such as metal (e.g., steel). But mechanisms made of a non-metallic material, specifically including plastic, do not depart from the scope of this invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations thereof is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism comprising:

a housing;

at least one ring for mounting loose leaf paper;

at least one connector member extending outwardly from the housing;

a base plate adapted to be attached to a substrate, the base plate having a surface adapted to receive the connector member of the ring binder mechanism; and a key adapted for sliding reception by the base plate into an affixingposition with respect to the base plate and connector portion of the housing for securing the connector member of the ring binding mechanism to the base plate, the key having a slot for receiving the connector member therein during sliding of the key into the affixing position, wherein the base plate comprises a web and opposing flanges attached to the sides of the web, each of the flanges and the web cooperating to define a channel for receiving a portion of the key to thereby connect the key to the base plate.

2. The ring binder mechanism as set forth in claim 1 wherein the key is formed separately from the base plate.

3. The ring binder mechanism as set forth in claim 2 wherein the key and base plate are constructed to lock the key in the affixing position.

4. The ring binder mechanism as set forth in claim 3 wherein the base plate further comprises a first locking element, and the key comprises a second locking element for engaging the first locking element to thereby lockingly secure the sliding member to the base plate.

5. The ring binder mechanism as set forth in claim 4 wherein the first and second locking elements are constructed for snap-acting engagement upon sliding reception of the key by the base plate.

6. The ring binder mechanism as set forth in claim 5 wherein one of the first and second locking elements comprises a resilient tongue projecting outward from one of the base plate and key at a non-orthogonal angle, and the other of the first and second locking elements comprises an opening sized and shaped to receive the tongue.

7. The ring binder mechanism as set forth in claim 4 wherein the first and second locking elements are selectively engagable so that the ring binder mechanism to be selectively secured to and released from the substrate.

8. The ring binder mechanism as set forth in claim 1 wherein the connector member comprises a mounting post and a flange at the end of the post.

9. The ring binder mechanism as set forth in claim 8 wherein the key comprises a web having said slot, the flange of the connector member being disposed between the web of the sliding member and the base plate to thereby secure the ring binder mechanism to the base plate when the key is received by the base plate.

10. The ring binder mechanism as set forth in claim 9 wherein the base plate includes a recess for receiving the flange of the connector member.

11. The ring binder mechanism as set forth in claim 1 wherein the key comprises a web and a lip extending at an angle to the web.

12. The ring binder mechanism as set forth in claim 11 wherein the lip is constructed and arranged to cover at least a portion of an edge of the substrate.

13. The ring binder mechanism as set forth in claim 12 in combination with a cover comprising a front panel, a back panel and a spine, the front and back panels being hingedly attached to the spine so that the panels are movable to selectively cover or expose loose leaf pages retained by the ring binder mechanism, wherein the lip of the key covers at least a portion of an edge of one of the spine, front panel, and back panel.

14. The ring binder mechanism as set forth in claim 1 in combination with a cover defining the substrate.

15. A ring binder comprising:

a ring binder mechanism including a housing having at least one ring for mounting loose leaf paper;

a cover having a front panel, a back panel and a spine, the front and back panels being hingedly attached to the spine so that the panels are movable to selectively cover or expose loose leaf pages retained by the ring binder mechanism;

at least one connector member extending outwardly from the housing; and a fastening component for securing the connector member to the cover, the fastening component including a lip for covering at least a portion of an edge of one of the spine, front panel, and back panel at the end, the fastening component comprising a key; and a base plate adapted to be attached to the cover, the key being adapted for sliding reception by the base plate into an affixing position with respect to the base plate and ring binder mechanism for securing the ring binder mechanism to the cover.

16. The ring binder set forth in claim 15 wherein the cover has openings for allowing a portion of the base plate to pass through the cover.

17. A ring binder mechanism comprising:

a housing;

at least one ring for mounting loose leaf paper;

at least one connector member extending outwardly from the housing;

a base plate adapted to be attached to a substrate, the base plate having a surface adapted to receive the connector member of the ring binder mechanism; and a key adapted for sliding reception by the base plate into an affixing position with respect to the base plate and connector portion of the housing for securing the connector member of the ring binding mechanism to the base plate, the key comprising a web and a lip extending at an angel to the web, the lip being constructed and arranged to cover at least a portion of an edge of the substrate when the key is in the affixing position.

18. The ring binder mechanism as set forth in claim 17 in combination with a cover comprising a front panel, a back panel and a spine, the front and back panels being hingedly attached to the spine so that the panels are movable to selectively cover or expose loose leaf pages retained by the ring binder mechanism, wherein the lip of the key covers at least a portion of an edge of one of the spine, front panel, and back panel.

19. A ring binder mechanism comprising:

a housing;

at least one ring for mounting loose leaf paper;

at least one connector member extending outwardly from the housing;

a base plate adapted to be attached to a substrate, the base plate having a surface adapted to receive the connector member of the ring binder mechanism; and a key adapted for sliding reception by the base plate into an affixing position with respect to the base plate and connector member of the housing for securing the connector member to the base plate, the key having a slot for receiving the connector member therein during sliding of the key into the affixing position, wherein (a) the key is formed separately from the base plate, (b) the base plate further comprises a first locking element, and the key comprises a second locking element for engaging the first locking element to thereby lockingly secure the key to the base plate, and (c) the first and second locking elements are constructed for snap-acting engagement upon sliding reception of the key by the base plate to lock the key in the affixing position.

20. The ring binder mechanism as set forth in claim 19 wherein one of the first and second locking elements comprises a resilient tongue projecting outward from one of the base plate and key at a non-orthogonal angle, and the other of the first and second locking elements comprises an opening sized and shaped to receive the tongue.

21. The ring binder mechanism as set forth in claim 19 wherein the first and second locking elements are selectively engageable so that the ring binder mechanism to be selectively secured to and released from the substrate.

22. A ring binder mechanism comprising:

a housing;

at least one ring for mounting loose leaf paper;

at least one connector member extending outwardly from the housing;

a base plate adapted to be attached to a substrate, the base plate having a surface adapted to receive the connector member of the ring binder mechanism; and a key adapted for sliding reception by the base plate into an affixing position with respect to the base plate and connector member of the housing for securing the connector member to the base plate, the key having a slot for receiving the connector member therein during sliding of the key into the affixing position, wherein the key comprises a web and a lip extending at an angle to the web.

23. The ring binder mechanism as set forth in claim 22 wherein the lip is constructed and arranged to cover at least a portion of an edge of the substrate.

24. The ring binder mechanism as set forth in claim 22 in combination with a cover comprising a front panel, a back panel and a spine, the front and back panels being hingedly attached to the spine so that the panels are movable to selectively cover or expose loose leaf pages retained by the ring binder mechanism, wherein the lip of the key covers at least a portion of an edge of one of the spine, front panel, and back panel.

25. The ring binder mechanism as set forth in claim 22 in combination with a cover defining the substrate.

* * * * *

UNITED STATES PATENT AND TRADEMARK OFFICE

CERTIFICATE OF CORRECTION

PATENT NO. : 7,513,708 B2
APPLICATION NO. : 11/216906
DATED : April 7, 2009
INVENTOR(S) : Cheng et al.

It is certified that error appears in the above-identified patent and that said Letters Patent is hereby corrected as shown below:

Column 11, Claim 1, Line 16: "portion" should read -- member --.

Column 11, Claim 1, Line 17: "of the ring binding mechanism" should be deleted.

Signed and Sealed this

Thirteenth Day of July, 2010

David J. Kappos

David J. Kappos
*Director of the United States Patent and Trademark Office*